United States Patent [19]

Artzt et al.

[11] Patent Number: 4,676,059

[45] Date of Patent: Jun. 30, 1987

[54] PROCESS AND DEVICE FOR STARTING SPINNING ON AN OPEN-END SPINNING APPARATUS

[75] Inventors: Peter Artzt, Reutlingen; Heinz Muller, Metzingen-Neuhausen; Gerhard Egbers, Reutlingen; Eberhard Grimm; Franz Schreyer, both of Ingolstadt, all of Fed. Rep. of Germany

[73] Assignee: Schubert & Salzer, Ingolstadt, Fed. Rep. of Germany

[21] Appl. No.: 865,198

[22] PCT Filed: Aug. 1, 1985

[86] PCT No.: PCT/DE85/00260

§ 371 Date: May 8, 1986

§ 102(e) Date: May 8, 1986

[87] PCT Pub. No.: WO86/01235

PCT Pub. Date: Feb. 27, 1986

[30] Foreign Application Priority Data

Aug. 8, 1984 [DE] Fed. Rep. of Germany ..... 3429131
Nov. 15, 1984 [DE] Fed. Rep. of Germany ..... 3441677

[51] Int. Cl.[4] ..... D01H 15/00

[52] U.S. Cl. ..... 57/263; 57/405; 57/408; 57/411

[58] Field of Search ..... 57/83, 261, 263, 264, 57/300, 301, 302, 304, 400, 404, 405, 408, 409, 411, 413

[56] References Cited

U.S. PATENT DOCUMENTS 3,354,631 11/1967 Elias et al. ..... 57/263
3,521,440 7/1970 Oskin et al. ..... 57/58.89
3,728,853 4/1973 Schiltknecht ..... 57/58.95
4,384,451 5/1983 Elias et al. .
4,497,166 2/1985 Artzt et al. ..... 57/263

FOREIGN PATENT DOCUMENTS 3104444 9/1981 Fed. Rep. of Germany .
2099555 3/1972 France .
2101153 3/1972 France .
526646 9/1972 Switzerland .
1170869 11/1969 United Kingdom .
1486161 9/1977 United Kingdom .
2069014 8/1981 United Kingdom .

*Primary Examiner*—Donald Watkins
*Attorney, Agent, or Firm*—Dority & Manning

[57] ABSTRACT

In preparation for the start of spinning with an open-end spinning apparatus, suction is provided outside a fiber transport path on the periphery of an opening roller. Such suction is greater than spinning suction which exists at the mouth of a feed channel leading to the fiber-collecting surface. The fiber stream is thereby guided beyond such mouth to be sucked off. At commencement of actual spinning, this added suction is inactivated, to permit the fiber stream to be initially supplied to the fiber-collecting surface. The fiber stream may be controlled with a suction source connected to a sucking-off orifice via a switching device and a suction line. Less conspicuous and more even thread joins are thereby obtained. Control of suction changes may be effected automatically from a servicing trolley, or in other manners. The invention may be practiced with a variety of types of spinning machines, including but not limited to open-end spinning machines having open end spinning rotors for thread formation or a plurality of friction rollers therefor.

49 Claims, 13 Drawing Figures

Fig. 2
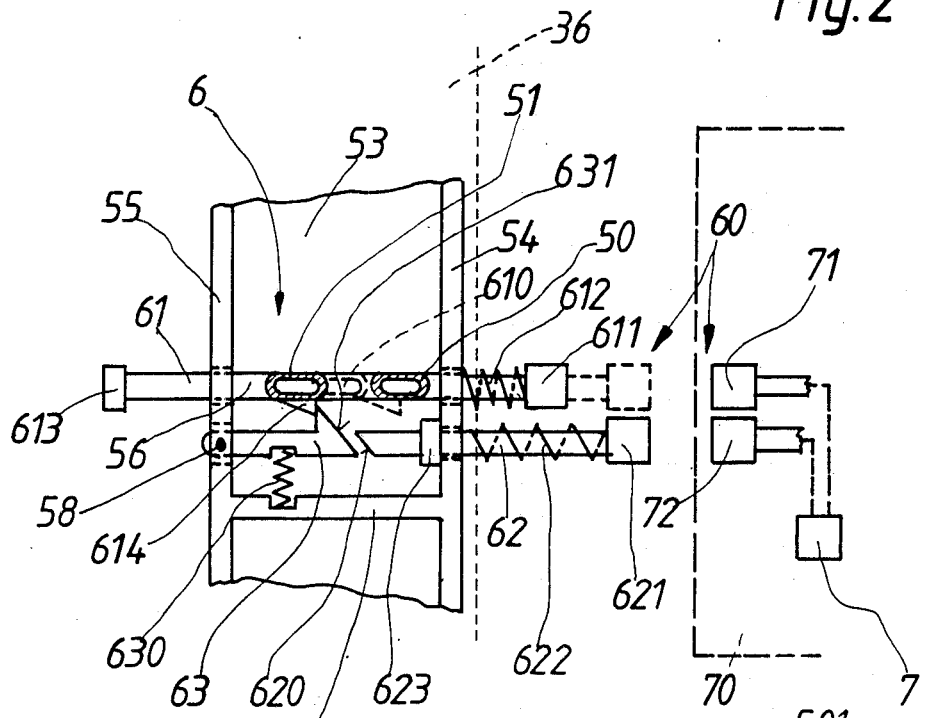
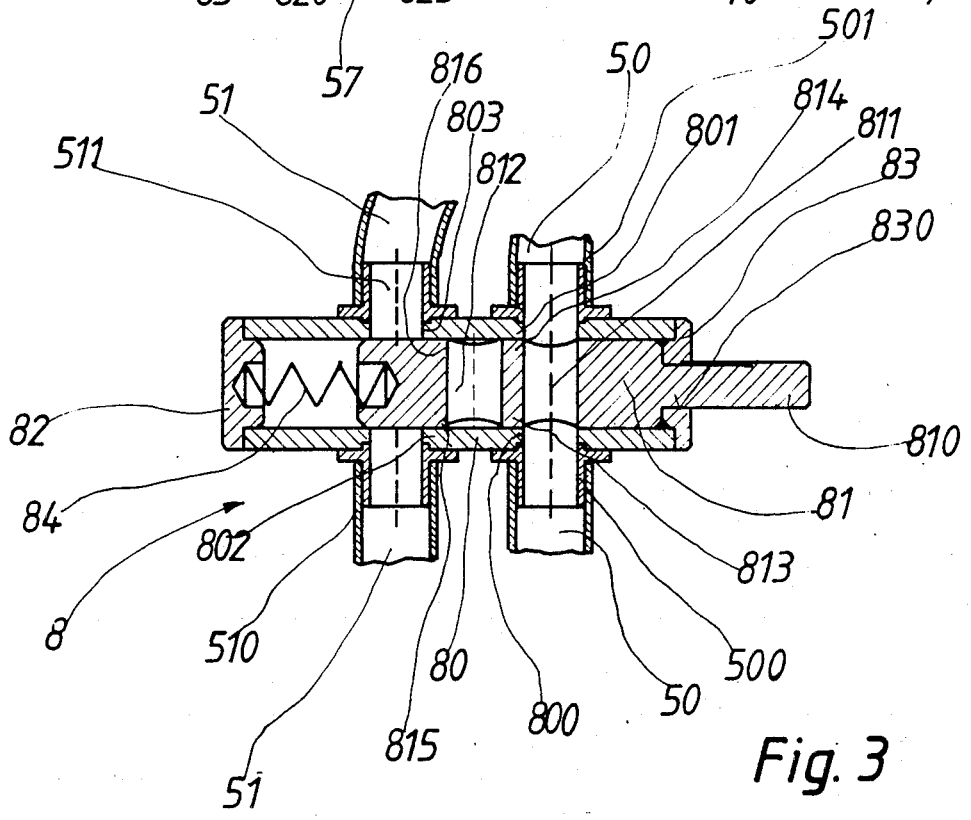
Fig. 3

PROCESS AND DEVICE FOR STARTING SPINNING ON AN OPEN-END SPINNING APPARATUS

BACKGROUND OF THE INVENTION

The present invention relates to a method and apparatus for starting spinning on an open-end spinning apparatus, generally of the type having a feed device for supplying a sliver to an opening roller received in a housing and from which separated fibers are supplied via a feed channel, by means of a suction-air stream, to a fiber-collecting surface for thread formation. Generally in accordance with this invention, at the start of spinning, a thread end is returned to the fiber-collecting surface, from which the previously returned thread is then drawn off again, with fibers being continuously tied in thereto. Further to prepare for the start of spinning, the feed device is switched on and while running, the fiber stream on its way to the fiber-collecting surface is deflected therefrom and instead at least partially supplied to a sucking-off device.

In conventional devices, when a thread breaks or the spinning process has stopped for any other reason, the feed device is stopped immediately to prevent unnecessary supply of fibers which clog and could otherwise damage the spinning apparatus. However, the opening roller usually continues to run, since stopping of such roller requires high technical precision (especially for each separate spinning station), and starting up and running down requires a considerable amount of time. As a result, the fiber tuft projecting into the region of the opening roller from the stopped feed device is stripped off completely. Before the spinning apparatus can be restarted, these fiber residues first have to be removed from the fiber-collecting surface. Such removal is required because these shortened and therefore damaged fibers sometimes prevent the spinning process from continuing satisfactorily. The issue of such phenomenen is raised in Swiss Patent Specification No. 526,646.

It is therefore known from the conventional practice of starting spinning and eliminating a thread break by hand that a spinner (an individual who operates a spinning apparatus) first operates the feed device for a short time, then cleans the spinning apparatus, and only after accomplishing that, pieces up the thread. Such activity, known as prefeed, removes the damaged part of the fiber tuft with the shortened fibers.

Even though a considerable number of the fibers are damaged by subsequent stoppage of the feed device during cleaning, sufficient fibers remain in the fiber tuft for spinning to start successfully. Stoppage of the feed device, dependent on the time required for cleaning, usually produced about the same fiber tuft conditions for the start of spinning. Hence, the success rate for piecing up thread was considerably improved with the above-mentioned prefeed technique, even at high rotor speeds and with difficult materials.

Knowing that damage to the fiber tuft is a function of the length of each stoppage of the feed device, it has been previously proposed to continue running the feed device, and then deflect and guide the fiber stream on its way to the fiber-collecting surface past same and instead into a sucking-off device. For this purpose, sucking-off orifices (such as disclosed by British Patent Specification No. 1,170,869) or compressed-air orifices (such as disclosed by German Patent Specification No. 3,104,444, which is equivalent to U.S. Pat. No. 4,384,451) are provided in the feed channel.

Even though, as a result of the uninterrupted fiber-feed and opening operation, undamaged fibers are supplied to the fiber-collecting surface exactly at a desired time, the spinning process is still disturbed by orifices of such type in a highly sensitive fiber transport path between the opening roller and the fiber-collecting surface. Hence, none of such prior proposals provide a practical solution for the above recognized and described technical problem.

SUMMARY OF THE INVENTION

An object of the present invention is to provide a method and an apparatus for starting spinning on an open-end spinning apparatus satisfactorily and reliably, and without any impairment of the subsequent spinning operation.

According to the invention, this and other objects are achieved by providing in preparation for the start of spinning a suction outside the fiber transport path on the periphery of the opening roller. The strength of such added suction is made greater than that of suction effective at the mouth of the feed channel, so that the fiber stream is guided beyond the mouth of the feed channel and sucked off. The added suction is rendered inactive at commencement of the actual start of spinning, so that the fiber stream is initially supplied to the fiber-collecting surface. All control and switching devices for the fiber stream are arranged outside the critical fiber transport path existing between the opening roller and the fiber-collecting surface. In such manner, the fiber stream is effectively deflected past the fiber-collecting surface and into a sucking-off device for the start of spinning, without the subsequent spinning process being impaired.

To prepare for the start of spinning, the strength of the spinning suction at the mouth of the feed channel is reduced so that fibers may be guided beyond such mouth. At commencement of the actual start of spinning, the added suction exerted outside the fiber transport path on the periphery of the opening roller is rendered inactive while at the same time the spinning suction at the mouth of the feed channel is restored to full effect. In such manner which is in accordance with the present invention, a relatively weak suction is sufficient to control the fiber stream on the periphery of the opening roller. Advantageously, for this purpose, the spinning suction is cut off to reduce its effect at the channel mouth.

In an alternative method also in accordance with the teachings of this invention, the spinning suction at the mouth of the feed channel is at least partially covered to reduce its effect. The fibers guided via the exposed (i.e. non-covered) part of the mouth of the feed channel pass into the feed channel and are thus forwarded to the fiber-collecting surface. Some of the fibers influenced by the covered region of the feed channel mouth become deflected and likewise pass into the feed channel. Because of inertia, other fibers guided via such covered region of the feed channel mouth do not become deflected and are subsequently sucked off beyond the mouth of the feed channel by the added suction provided in accordance with this invention on the periphery of the opeing roller.

To obtain high quality, inconspicuous thread joins, it is preferred in one form of the invention, at the commencement of the actual start of spinning, to reduce over a period of time the amount of added suction (i.e. negative pressure) provided outside the fiber transport path on the periphery of the opening roller. Alternatively, the effect of the spinning suction at the mouth of the feed channel may be relatively increased. In either manner, the fiber stream controllably passes into the feed channel so as to gradually increase up to its full thickness. At the same time, such increase in the fiber stream desirably takes place as a function of the increase in the thread draw-off speed, thereby preventing a change of yarn count in this spinning phase.

In this instance, operation may be such that at the start of spinning only a small percentage of fibers in the fiber stream are initially supplied to the fiber-collecting surface, while the remaining fibers in the fiber stream are guided beyond the mouth of the feed channel. Also, the thread end is then returned to the fiber-collecting surface. After the fibers located on the fiber-collecting surface have been tied in, the proportion of fibers in the fiber stream supplied to the fiber-collecting surface may be increased. Such operation achieves in a straightforward manner further objects of this invention, including synchronization of thread return with thread draw-off on one hand, and with fiber feed on the other hand.

Accumulation of fibers required for the start of spinning is built up at a low fiber feed rate, so that large numbers of fibers can no longer settle on the prefed fibers during the time from the subsequent thread piecing until the prefed fibers are tied in. Thus, a relatively high quality, inconspicuous thread section is obtained adjacent the thread join, without any observable thin portion as occurs with conventional methods and devices.

In one present method of obtaining such inconspicuous thread joins of high strength, to prepare for the start of spinning, the fiber stream is initially guided beyond the mouth of the feed channel. Subsequently, the fiber stream is briefly supplied to the fiber-collecting surface and is then again guided beyond the mouth of the feed channel. The fiber stream is subsequently supplied to the fiber-collecting surface only after the thread end has reached the fiber-collecting surface and the draw-off of the thread has started.

To control the fiber stream so as to prepare for the start of spinning, another aspect of this invention concerns generation of a suction flow on the periphery of the opening roller in such manner that (with spinning suction unchanged) at least a partial reversal of the air flow in the feed channel takes place. Also, the air stream thus generated, on its way from the feed channel into a sucking-off device provided on the periphery of the opening roller, at least partially carries with it fibers transported by the opening roller.

So that the general purposes of this invention may be achieved without requiring excessively high suction power from any added sucking-off device, a further form of this invention cuts off other air flow into the housing of the opening roller so as to reverse the air flow in the feed channel. To advantageously divert the fiber stream gradually onto the fiber-collecting surface, the reactivation of such other air inflows is controlled in such manner that the quantity of fibers supplied to the fiber-collecting surface is also controlled.

After spinning has started, the added suction outside the fiber transport path on the periphery of the opening roller is no longer required. Hence, such suction may be appropriately cut off by deactivating the added sucking-off device after the operation to start spinning is completed.

So that fibers do not unintentionally reach the fiber-collecting surface while a thread break is being rectified, advantageously in accordance with further aspects of this invention, the feed device may be stopped when a thread break occurs. After the fiber-collecting surface is cleaned, the feed device is switched on again, but with the fiber stream being guided beyond the mouth of the feed channel.

Stopping the supply of fibers to the opening roller while it continues to run ensures that the opening roller shaves off the fiber tuft of the sliver clamped in the feed device, which fiber tuft extends into the working range of the opening roller. The fibers supplied to the fiber-collecting surface, as a result of the spinning suction taking effect as before, are eliminated pneumatically by means of such spinning suction. After such cleaning phase, the feed device is switched on again, but the fiber stream is guided beyond the feed channel mouth so that the fibers damaged by the shaving-off action do not reach the fiber-collecting surface, but are instead discharged from the housing of the opening roller.

To obtain reliable thread joins of high quality in uncomplicated fashion in rotor spinning, advantageously and in accordance with this invention, and to prepare for the start of spinning: initially the spinning suction is effective in the rotor housing, the thread end is fed into the spinning apparatus without touching the fiber-collecting surface, subsequently the spinning suction is deactivated while the added suction outside the fiber transport path on the periphery of the opening roller is activated such that when the feed device is switched on again the fiber stream is guided beyond the mouth, of the feed channel and sucked off, and at the commencement of the actual start of spinning this added suction is removed while the spinning suction is again provided so that the fiber stream is supplied to the fiber-collecting surface and the thread end is returned also to the fiber-collecting surface.

In devices having a fiber transport roller arranged after an opening roller, an alternative embodiment of the present invention may prepare for the start of spinning by exacting suction outside the fiber transport path on the periphery of such fiber transport roller, instead of on the periphery of the opening roller.

A device generally in accordance with the teachings of this invention may have a suction source means for generating a suction-air stream which transports fibers through a feed channel to a collecting surface. It may further have a sucking-off orifice in the peripheral wall of a housing for an opening roller outside of the fiber transport path, with the suction source connected to such sucking-off orifice via a switching device and a suction line. Such structure and function thereof, as discussed in detail below, ensures that no fibers damaged by being shaved off can enter the spinning unit, with the beneficial result that the fibers forming the thread join fully contribute to the strength of the join.

According to yet another advantageous aspect of the subject invention, the added suction source in accordance therewith may be assigned via a switching device either to the fiber-collecting surface to provide a spinning suction or to the sucking-off orifice for sucking off the fibers. As a result, switching of suction for eliminating fibers from the roller housing so that fibers do not enter the spinning unit, or for supplying fibers into the spinning unit, can be matched as desired with controlled precision to the requirements of the operation for starting spinning.

If the switching device occupies a preferred intermediate position, both the fiber-collecting surface and the sucking-off orifice can be at least partially provided suction at the same time. In this way, the supply of fibers can be controlled, and by monitoring the nature of the switching movement (regular movement, irregular acceleration or deceleration movement, or the like), switching of the suction conditions can be matched exactly with the operation of starting spinning according to the fiber material to be processed and the present spinning condition selected.

Yarn and fiber residues must not be permitted to settle within the switching device during the sucking-off operation. For this reason, the fiber stream should not undergo any deflections in the switching device. To avoid such deflections and in accordance with a further aspect of this invention, the switching device may be provided with two control bores. One of such bores can be brought in line with a first suction line leading to the fiber-collecting surface, while the other can be brought in line with a second suction line leading to the sucking-off orifice.

So as not to impair the functional reliability of the switching operation, there should be no possibility that yarn and fiber residues can become jammed in an air control device associated therewith. To avoid such jamming and in accordance with the present invention, the stationary edges of the switching device and movable edges thereof which may be brought in line with the stationary edges can be formed as cutting devices useful for preventing jams.

To make it easier to switch the fiber stream, as yet a further aspect of the subject invention, the housing of the opening roller may be closed against air inflows. As a result, no uncontrolled air flow in the housing of the opening roller can influence the spinning process. Thus, when a sufficiently strong suction is exerted at the sucking-off orifice provided in the peripheral wall of the housing of the opening roller (with the spinning suction remaining unchanged), the air flow in the feed channel is reversed. The fibers are consequently supplied to the sucking-off orifice provided beyond the mouth of the feed channel.

So that the fiber stream does not have to be controlled by means of the suction exerted at the sucking-off orifice, in achievement of yet further objects of this invention, the housing of the opening roller may be provided with a controllable air-inflow orifice, which is preferably arranged in the peripheral wall of the housing for the opening roller between the feed device and the mouth of the feed channel.

If a dirt separation orifice is provided in the housing of the opening roller, such dirt separation orifice may be formed as a controllable air-inflow orifice in accordance with the foregoing object of this invention.

On present day open-end spinning machines, spinning is frequently started (or re-started) with the aid of a servicing trolley which may be movable along several spinning units. In such cases, it is desirable to be able to control air inflow from the servicing trolley.

In one preferred form of the subject invention, a closing member designed as a flap is associated with an air inflow passage. Such a flap-like closing member may be movable in a simple manner between various positions for example by means of pivoting, and can also be positionally controlled by the air itself. So that the fiber stream can also be controlled in terms of quantity during a switching operation, the air-inflow orifice may also be provided a closing member which can be moved in a non-uniform (e.g. non-linear) way by means of or responsive to a control device.

Switching of the fiber stream in accordance with this invention is not limited to being carried out pneumatically by controlling the air flow in the housing. Alternatively, for example, mechanical control of the fiber stream is also possible. Thus, in a further embodiment of the subject invention functionally equivalent to the earlier-described embodiments, a controllable diaphragm covering the mouth of a feed channel may be provided in the housing for the opening roller.

The mechanical diaphragm approach also makes it possible to very accurately reroute the fiber stream. It also makes it possible to readily switch the fiber stream gradually from the sucking-off orifice to the fiber discharge orifice, and consequently to the spinning unit. Of course, any and all other functional equivalents for these and other aspects of the present invention come within the spirit and scope of same, and hence are included either expressly as the doctrine of equivalents within the appended claims.

As still another feature of the present invention, to prevent fibers from accumulating in front of the closed fiber discharge orifice, the closing member thereof may be advantageously provided as essentially an integral extension of the periheral wall of the housing of the opening roller.

To ensure also that no fibers become caught on a diaphragm associated with an embodiment of this invention when the diaphragm assumes a closed position, such diaphragm may be overlapped (similar to the manner of a roof tile) by the peripheral wall of the housing for the opening roller at its leading end (defined as that which is perceived first when viewing same in the fiber transport direction), while its other end overlaps the peripheral wall of the housing of the opening roller (in the same roof-tile manner), with the result that there are no projecting edges formed (as viewed in the fiber transport direction).

It is advantageous, particularly for the gradual switching of the fiber stream, if the closing member is movable parallel to the axis of the opening roller. To achieve a gradual switching of the fiber stream, the closing member may have, between its region effecting the complete covering of the fiber discharge orifice and the region effecting the complete opening of the fiber discharge orifice, a profile which admits to control of the degree of opening. This may be preferably designed in one embodiment as a nose member. As a result, a large cross-section of the fiber discharge orifice may be initially opened with same temporarily reduced again by means of such nose, until ultimately the entire cross-section of the fiber discharge orifice is opened.

Alternatively, to achieve a desired gradual switching, a control device can act on the diaphragm so as to move same in a non-uniform or non-linear way. The closing member can thus be brought from its closed position into its open position at a changing instead of constant speed, and, if desired, even stopping in one or more intermediate positions. All variations to such schemes which further the purposes of specific embodiments or achieve given criteria set forth by design constraints dictated by individual circumstances are intended to come within the broader teachings of this invention.

It is presently known to control the start of spinning from a servicing trolley which is movable along several spinning units, as mentioned above. In such case, the switching device in accordance with this invention may be adapted to be controlled from such a servicing trolley.

The device for controlling added suction may have various designs. For example, it can be embodied as a fan which may be controlled from the aforementioned servicing trolley. However, it is preferably formed by a valve, particularly a non-return valve.

In principle, the switching of suction conditions can be controlled in any known way, for example by electromechanical, hydromechanical or pneumomechanical means. According to one preferred embodiment of the subject invention, switching is carried out mechanically, with the switching device being actuated in one direction of movement by a control drive, with a spring element provided for return of the switching device in the opposite direction.

In accordance with this invention, when a servicing trolley is provided of the type which can be selectively advanced to one of a plurality of spinning stations, a second suction source may be provided on such servicing trolley to which a sucking-off orifice may be connected instead of to the first or primary suction source.

To make additional drive means for the switching device unnecessary, the switching device can be advantageously controlled by connecting a suction-air line extending from the second suction source to the switching device.

If a fiber transport roller is arranged after the opening roller in a particular open-end spinning apparatus, according to this invention a sucking-off orifice can be arranged in the peripheral wall surrounding the fiber transport roller, instead of in the wall surrounding the opening roller.

The present invention makes it possible to control the supply of fibers into a spinning chamber by means of a relatively straightforward device, but in such a way that only perfect fibers enter the spinning chamber for the start of spinning. Since all the control and switching devices for the fiber stream are arranged outside the critical fiber transport path existing between the opening roller and the fiber-collecting surface, it is ensured that the fiber stream is effectively deflected past the fiber-collecting surface into a sucking-off device (or alternative collection area, or the like) for the start of spinning, without the subsequent spinning process being impaired. This invention even makes it possible to control the fiber stream in terms of quantity, so that not only is a thread join made, but the appearance of the joins is also improved to a considerable extent, without the necessity of providing additional devices for the controlled drive of the feed device. The best possible success rate for the start of spinning is thus obtained.

BRIEF DESCRIPTION OF THE DRAWINGS

The foregoing aspects and numerous further objects and features of the present invention will be better and completely understood by those skilled in the art upon considering the following exemplary preferred embodiments of both the method and apparatus of the invention, as discussed in detail in the remainder of the specification, which is related by way of explanation to the appended figures, in which:

FIG. 2 shows, in plan view, one form of a switching device according to this invention, with same arranged on the outside of a suction channel;

FIG. 3 shows, in cross-section, an alternative embodiment of a switching device according to this invention;

Figure 1:
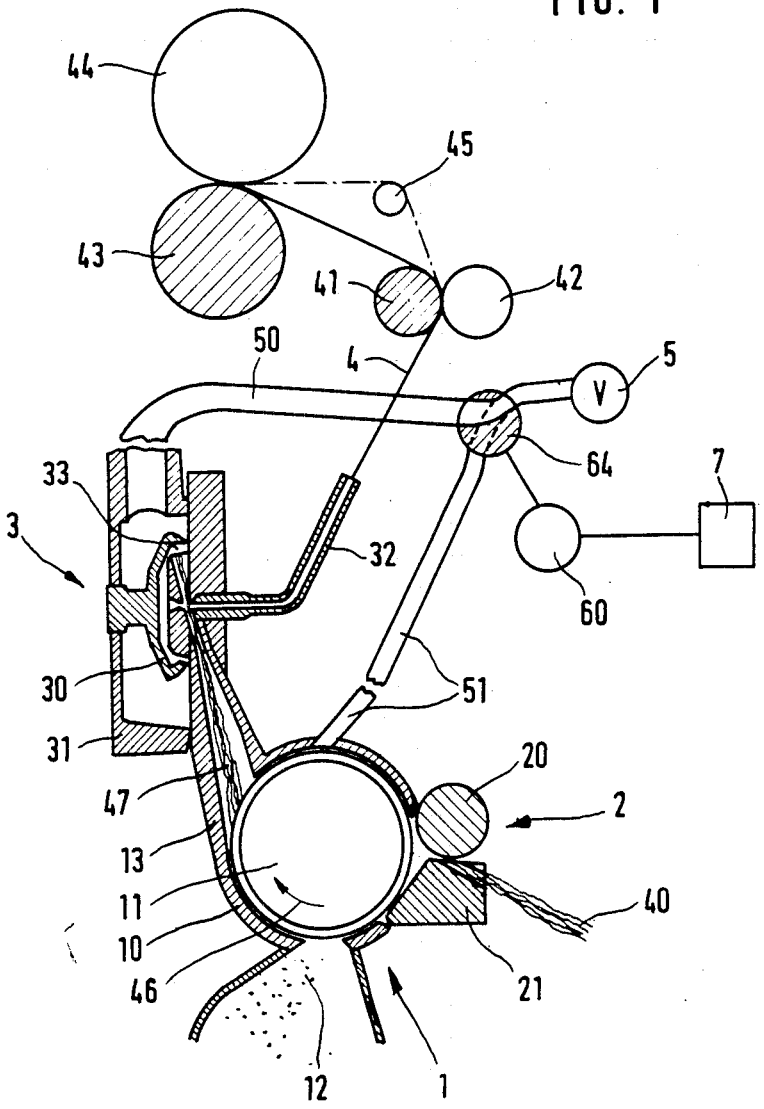
FIG. 1 illustrates, in diagrammatic cross-section, an open-end spinning apparatus provided in accordance with the present invention.

Use of like reference characters throughout the figures indicates like or analogous elements. The following embodiments are by way of example only, and other embodiments of this invention and all equivalents of any embodiments (specifically illustrated or otherwise) of this invention are also included within the broader teachings of the present disclosure. Furthermore, language of this specification should be construed as words of description, and not words of limitation, which such words are set forth only in the appended claims.

DETAILED DESCRIPTION OF THE PREFERRED EMBODIMENTS

FIG. 1 illustrates a spinning station of a rotor-spinning machine, but this invention may also be used advantageously on other types of open-end spinning machines, for example friction-spinning machines.

With reference to the drawings, each spinning station of the exemplary rotor-spinning machine illustrated possesses an opening device 1 having an opening roller 11 arranged in an opening-roller housing 10. Sliver 40 is fed to opening device 1 by feed device 2 which, in the exemplary embodiment illustrated, includes a driven feed roller 20 and a feed trough 21 interacting elastically with the feed roller 20. In the exemplary embodiment shown, dirt separation orifice 12 is also provided in peripheral wall 101 (FIG. 5) surrounding opening roller 11 and belonging to opening-roller housing 10. Furthermore, mouth 130 (FIG. 4) of feed channel 13 leading to open-end spinning apparatus 3 is provided in peripheral wall 101 of the opening-roller housing 10.

Open-end spinning apparatus 3 typically may have a spinning unit comprising a spinning rotor 30 surrounded by a housing 31. Coaxial to spinning rotor 30, thread draw-off tube 32 opens into housing 31, and through it a thread 4 can be drawn off from spinning rotor 30. Draw-off rollers 41 and 42 are provided for this purpose. Thread 4 is wound onto bobbin 44 which is driven by spooling roller 43. To release a thread return portion previously formed for starting spinning, a throw-off magnet 45 is provided in the vicinity of the thread run between the spooling roller and the draw-off rollers.

To generate necessary spinning suction, suction line 50 communicates with suction source 5 and is connected to housing 31. Air being sucked into housing 31 through thread draw-off tube 32 can reduce the effect of spinning suction acting in housing 31 adjacent feed channel 13 and its mouth 130.

In addition to the first suction line formed by line 50, there is a second suction line 51 which communicates with open-end spinning apparatus 3. One end of second suction line 51 terminates in sucking-off orifice 52. From the perspective of the fiber transport direction (illustrated by arrow 46), orifice 52 is provided downstream from mouth 130 of feed channel 13, and upstream from feed device 2. Furthermore, orifice 52 is located outside the fiber transport path, in the peripheral wall 101 of opening-roller housing 10.

Second suction line 51 is also connected to the suction source 5 via a switching device 64. In the exemplary embodiment illustrated, switching device 64 is presented as a rotary valve. Using switching device 64, which is also operatively associated with first suction line 50, the first or the second suction line can alternately be connected to suction source 5. Such operation permits controlled assignment of suction power from source 5 to either fiber-collecting surface 33 of spinning rotor 30 to provide spinning suction, or to sucking-off orifice 52 to provide sucking off of the fibers 47. For such switching, device 64 is connected to a drive device 60 controlled by a suction control device or means 7 for selectively providing such spinning suction or sucking off (i.e. discharging or deflecting) of fibers.

The position of switching device 64 represented by solid lines in FIG. 1 is its spinning position, in which spinning suction is generated in spinning rotor 30. The position indicated by broken lines is its fiber discharge position, in which suction is provided at sucking-off orifice 52. Thus, fibers 47 are controllably conveyed into either feed channel 13 or into sucking-off orifice 52, depending on the position assumed by switching device 64.

A filter (not shown) for capturing fibers 47 sucked off may, of course, be provided at any suitable point along suction line 51.

Sliver 40 to be spun into thread is supplied to opening device 1 by feed device or means 2 and is opened up into individual fibers 47 by opening roller 11. Opening roller 11 transports fibers from feed device 2 into feed channel 13, and at the same time permits dirt constituents contained in the fiber material to be thrown out through dirt separation orifice 12. Fibers 47 pass into spinning rotor 30 and there are received on the fiber-collecting surface 33, where they are tied into the end of thread 4. This thread is drawn off from spinning rotor 30 by draw-off rollers 41, 42 and is wound onto the bobbin 44. During such normal spinning process, switching device 64 assumes its spinning position, in which suction generated by means of suction source 5 is provided as spinning suction via first suction line 50 to housing 31 and, to a lesser extent, at mouth 130. During such time, operative connection between second suction line 51 and suction source 5 is broken so that no suction force is provided to second line 51.

If a thread should break, the spinning process is interrupted in a known way via a thread monitor (not shown) and the spinning station is stopped. In response, feed device 2 is stopped to prevent sliver 40 from being supplied to opening roller 11 and subsequently to spinning rotor 30. However, housing 31 still remains connected to suction source 5. Subsequently, spinning rotor 30 is braked. At the same time, fibers 47 still remaining in spinning rotor 30 and the end of the broken thread are loosened from the thread-forming region or fiber collecting surface 33 of spinning rotor 30 as a result of the introduction of mechanical or pneumatic cleaning means and are then sucked off from there.

As early as this cleaning phase or just after it, thread 4 present on bobbin 44 is drawn off and shortened to a specific length to form a thread reserve, brought via the armature of throw-off magnet 45 in front of the mouth of thread draw-off tube 32. By means of the spinning suction also effective in thread draw-off tube 32, the thread member is then introduced into spinning rotor 30 without touching fiber-collecting surface 33.

To make it impossible for further fibers 47 to be deposited on fiber-collecting surface 33 of spinning rotor 30 after rotor 30 has been cleaned and after the feed device 2 has been switched on again, and to prepare for the start of spinning, switching device 64 is subsequently brought into its fiber discharge position (which involves second suction line 51 as discussed above). Feed device 2 is then switched on again. The fiber stream is now sucked out of opening-roller housing 10 through sucking-off orifice 52. Since spinning rotor 30 is stopped and the spinning suction otherwise associated with first suction line 50 is also cut off from housing 31 of the open-end spinning apparatus 3, the suction-air stream present at sucking off orifice 52 is sufficient to convey fibers 47 over mouth 130 of feed channel 13 to sucking-off orifice 52. Such suction stream is counter to the effect of the centrifugal force generated by the rotating opening roller 11. This ensures that fibers 47, which during such stopping phase have been shaved off and thereby shortened by the continued running of opening roller 11, cannot enter spinning rotor 30 and thereby reduce the strength of a thread join.

During return of thread 4 in front of the mouth of thread draw-off tube 32, the thread end in a known way acquires a form advantageous for the start of spinning. Switching device 64 is operatively controlled so as to be brought into its spinning position, such that the suction formerly provided sucking-off orifice 52 is cut off, and the suction within spinning rotor 30 and at mouth 130 of feed channel 13 is cut on (i.e. provided thereto generally by first suction line 50).

When thread 4 is thrown off from throw-off magnet 45, it is returned to fiber-collecting surface 33 as a result of spinning suction acting in spinning rotor 30 since switching device 64 is in its spinning position. The thread end comes into contact with the fibers 47 which are located on fiber-collecting surface 33, which is where a fiber ring is formed (for the type of spinning rotor illustrated in the exemplary embodiment). Then, with fibers 47 being continuously supplied and tied in uninterruptedly, the thread 4 is drawn off from spinning rotor 30 and wound onto bobbin 44.

Switching operations of switching device 64 are carried out by means of a drive device 60 which receives its control commands from control device or means 7. Control device 7 usually also controls, in addition to switching device 64, further operations apart from starting spinning and rectifying thread breaks. Such additional operations may include changing a bobbin or the like.

To prevent thread breaks during the start of spinning, it is desirable to ensure that a thin portion of thread does not follow a given joining point. Consequently, at the moment when thread is joined, there should be present a quantity of fiber corresponding to the yarn count in the thread-forming region 33 of the spinning rotor 30. Since a thread end intended for the start of spinning is usually not tapered, but is merely opened by means of splicing, the thread join thus in cross-section has double the fiber mass of the spun thread.

While thread is drawn off from spinning rotor 30, additional fibers 47 are continuously supplied to fiber-collecting surface 33 of rotor 30, so that the fiber ring deposited therein continues to grow and eventually exceeds the thickness of the spun thread 4. The fiber ring increases in size until the tie-in point determined by the draw-off rollers 41 and 42 again reaches an initial position for piecing in relation to the rotor periphery. Only at the moment when the fiber feed and thread draw-off reach the same ratio as during production does thread 4 have the desired nominal thickness.

To avoid the need for complex and expensive control devices for feed device 2, it is often-provided with only the simple capability of being switched on and off. Due to respective forces of inertia, draw-off rollers 41 and 42 and bobbin 44 require a longer time than the slow-running feed device 2 before they reach their final production speed. There is therefore always a finite amount of time before synchronization is achieved among the various components.

Consequently, there forms after a thread join (forming a relatively thicker portion) a thread portion of relatively smaller cross-section which is followed by a second thicker portion. Such events cause difficulty from that point in time right up to further processing, especially since such thread portion is much longer than the thread join.

To avoid such second thick (thicker) portion, it is necessary for the quantity of fibers fed into spinning rotor 30 to be matched to the existing thread draw-off speed. For this purpose, increases in the fiber stream between feed device 2 and spinning rotor 30 are controlled. To achieve such control, switching device 64 is not switched from its fiber discharge position into its spinning position abruptly, but instead gradually. Therefore, increase in the fiber stream takes place as a function of the increase in the thread draw-off speed. This is made possible because, in an intermediate position of switching device 64, both fiber-collecting surface 33 and sucking-off orifice 52 are provided some suction force at the same time. Thus, in a transitional phase, suction acts to some extent at the sucking-off orifice 52 and in the housing 31 of open-end spinning apparatus 3, so that fibers 47 pass onto fiber-collecting surface 33 of the spinning rotor 30 gradually at an increasing feed rate.

Such operation is more specifically detailed as follows.

To prepare for the start of spinning, the fiber stream is first discharged again through sucking-off orifice 52, as described above. Then, switching device 64 is first moved only slightly out of its fiber discharge position towards its spinning position, so that spinning suction (in line 50) increases gradually and suction (along line 51) at sucking-off orifice 52 decreases gradually. Thus, initially only relatively few fibers 47 enter spinning rotor 30, while the remaining fibers 47 continue to be transported beyond mouth 130 of feed channel 13 and discharged therefrom through sucking-off orifice 52. Switching device 64 remains in such intermediate position until the fiber ring building up slowly in rotor 30 has reached the nominal thickness desired for the start of spinning.

The thread end is then returned in a known way to fiber-collecting surface 33 of rotor 30 and laid onto such fiber ring, tied in thereto in a conventional manner, and then drawn off again from spinning rotor 30. Even though feed device 2 is switched on during such time, relatively few fibers 47 pass into spinning rotor 30, since most fibers 47 are sucked into sucking-off orifice 52. The fiber ring thus increases in size only slowly, with the advantageous result that the usually thick portion following the thread join after a short thinner thread portion (described above) is instead relatively inconspicuous. The thickness of such thinner thread portion is determined by the quantity of fibers which is contained in the fiber ring at the moment when spinning starts and which is itself fixed by the duration of the fiber prefeed.

Fibers already located within spinning rotor 30 at the time when spinning starts are continuously tied into the thread end. After the fibers have been tied in such manner, the spinning suction provided to spinning rotor 30 is progressively increased as a function of the increase in the thread draw-off, with the result that the proportion of fibers entering spinning rotor 30 also increases. Such increases continue until finally maximum suction is exerted at mouth 130 of feed channel 13, and sucking-off orifice 52 is no longer subjected to any suction from source 5. At such time, all of fibers 47 pass into spinning rotor 30.

Reduction of the suction outside the fiber transport path (i.e. at sucking-off orifice 52) and increase of the spinning suction in spinning rotor 30 and at mouth 130 of feed channel 13 take place over a relatively long period of time. Hence, the fiber stream correspondingly enters the feed channel 13 gradually and increasingly up to its full thickness.

One construction of a device for starting spinning in accordance with the present invention is more specifically described hereinafter with reference to FIGS. 1 and 2.

FIG. 2 shows the underside of a suction channel 53 which is connected to suction source 5 (FIG. 1), and which extends in customary fashion over a plurality of spinning stations, such as rotor-spinning stations arranged next to one another. For each respective open-end spinning apparatus 3, a switching device 6 is provided on suction channel 53. Channel 53 has webs 54 and 55 on each of its longitudal undersides. Two regulating elements 61 and 62 are mounted in web 54 facing a designated tending side (i.e., on the right in FIG. 2).

Regulating element 61 has a slot 610, by means of which suction line 50 or 51 can be connected to orifices provided in line therewith in the underside of suction channel 53. Furthermore, regulating element 61 is guided sealingly between the underside of suction channel 53 and a sealing strip 56 which connects the two webs 54 and 55 to one another. Slot 610 has a minimum size corresponding to that of the cross-sections of suction lines 50 and 51, but can also have a greater length, as will be explained below.

At its end facing the tending side of spinning machine 36 (i.e., on the right in FIG. 2), regulating element 61 has an enlarged actuating knob 611. Supported on actuating knob 611 is one end of a spring element 612, the other end of which is supported on web 54. Regulating element 61 possesses at its other end a stop 613 which retains regulating element 61 in its spinning position when it is released, in which position suction line 50 is connected to suction channel 53.

Regulating element 61 has on its longitudinal side an engaging nose 614, behind which a pawl 63 can engage.

Pawl 63 is mounted so as to be pivotable about an axle 58 provided in web 55, and is stressed elastically by a spring element 630. The other end of spring element 630 is supported on a web 57 which connects the two webs 54 and 55 to one another.

Pawl 63 has at its end facing web 54 a ramp-like slope 631, onto which the bevelled end 620 of the regulating element 62 can run. The end of regulating element 62 facing away from such bevelled end 631 has an enlarged actuating knob 621. A spring element 622 is supported between actuating knob 621 and web 54, so that regulating element 62 is stressed towards the aforementioned tending side of the machine. To limit movement caused thereby, regulating element 62 carries a stop 623 between web 54 and bevelled end 620.

Arranged on a servicing trolley 70, which is movable along the tending side of spinning machine 36 (and which can thus attend selectively to any spinning station of a plurality of spinning stations of this type), is control device (or means) 7 which, as discussed above, controls operations to start spinning, and the like. Control device 7 is suitably connected in a control sense to drive bolts 71 and 72, which in combination with actuating knobs 611 and 621, form a drive device 60 for switching device 6.

Drive bolts 71 and 72 may, for example, each comprise part of an armature of an electromagnet, or any equivalent constructions. If the drive bolts are driven in gradations (such as in segments) or during various phases of movement at alternating or differing speeds, it is also possible to use for a drive means a stepping motor or the like.

FIG. 2 illustrates switching device 6 in its fiber discharge position, with slot 610 making connection between suction channel 53 and suction line 51. In such position, regulating element 61 is secured by pawl 63 which is engaged behind engaging nose 614. When switching device 6 is to be brought into its spinning position, actuating knob 621 is acted on either with drive bolt 72 of the servicing trolley 70 or, if desired, by hand.

During movement of regulating element 62, the restoring spring 622 is tensioned. Ultimately, regulating element 62 contacts slope 631 of pawl 63 with its bevelled end 620, and thereby pivots the pawl in a direction opposite to the effect of restoring spring 630. In response, pawl 63 releases engaging nose 614, and regulating element 61 is permitted to return, by virtue of the relaxed restoring spring 612, to its basic position which is illustrated by the broken lines in FIG. 2. Such basic position is fixed by stop 613.

After actuating knob 621 has been released, regulating element 62 also returns again by means of relaxed restoring spring 622 into the initial position shown, in which stop 623 is brought to rest against web 54. Released pawl 63 is then moved up against regulating element 61 by restoring spring 630.

Switching device 6 may be brought into its fiber discharge position at a later time with actuation of actuating knob 611 by means of drive bolt 71 or by hand. With restoring spring 612 being prestressed at the same time, regulating element 61 is moved into the position illustrated, in which it is secured by pawl 63 engaging with engaging nose 614.

In the exemplary switching device 6 illustrated in FIG. 2, the slot 610 has a larger orifice than the cross-section of suction line 50 or 51, so that in an intermediate position thereof, slot 610 partially opens communication between suction channel 53 and both the first suction line 50 and the second suction line 51. Such an intermediate position enables both the fiber-collecting surface 33 and the sucking-off orifice 52 to receive suction at the same time, albeit possibly in differing amounts. This ensures that during switching fibers 47 are not simply abandoned suddenly, but are instead always contained in a suction-air stream.

It can be very important, where some fiber materials and yarn counts are concerned, to coordinate the fiber quantity exactly with the moment of the start of spinning. Due to increasing speeds for the start of spinning, the time available for such coordination is consequently decreasing. Also, since fibers 47 arrive in spinning rotor 30 with a delay which cannot be predetermined with sufficient accuracy, it is not possible to provide a precisely defined fiber quantity when fiber release starts suddenly.

However, if fibers do not enter the spinning rotor abruptly, but instead with a gradually increasing feed rate, it is possible to achieve an exact feed of fibers into spinning rotor 30, without the moment for the start of spinning and the release of fibers 47 having to be coordinated with one another with respect to narrow tolerances of time. Since the fiber control for the start of spinning takes place during transition from a first phase of the start of spinning to a second phase, gradual control of the switching device 6 is advantageous only in this period. Switching device 6 can be switched at any speed in other periods of operation.

To actuate switching device 6 at the desired switching speed, the two drive bolts 71 and 72 are brought by means of control device 7 into engagement with actuating knobs 611 and 621, which initially assume the position illustrated in FIG. 2. Regulating element 62 then pivots pawl 63 which accordingly releases regulating element 61, as discussed above. Drive bolt 71 now returns to its initial position. However, such return movement does not take place suddenly, but instead gradually at a predetermined speed which changes if appropriate, so that regulating element 61 resting against drive bolt 71 by means of its actuating knob 611 also gradually returns to its position represented by the broken lines of FIG. 2. At a given time resulting from the release of regulating element 62, pawl 63 is also released.

In its initial position, regulating element 61 only opens communication to second suction line 51. In such fiber discharge position of switching device 6, fibers 47 supplied by the feed device are sucked out of housing 10 through sucking-off orifice 52, and are thus prevented from entering spinning rotor 30.

After regulating element 61 has moved a predetermined distance, slot 610 is moved to a position such that the suction effective in suction channel 53 is provided to some extent in both the first suction line 50 and the second suction line 51. Some of fibers 47 are therefore brought into rotor 30 which is already rotating again, while other fibers 47 continue as before to be sucked into suction line 51 via sucking-off orifice 52. With increasing displacement of regulating element 61, the suction in first suction line 50 is increased while suction in second suction line 51 is decreased.

Such change-over of switching device 6, which is dependent upon the speed of displacement of regulating element 61, causes the supply of fibers 47 into the spinning rotor 30 to be gradually increased, so that the fiber quantity required at the moment of the start of spinning is fixed in a direct and relatively simple way, and can be desirably coordinated with increases in the thread draw-off speed. This ensures a high degree of reliability at the start of spinning.

The exemplary switching device 6 described with reference to FIG. 2 readily allows either actuation from a servicing trolley 70 or manual actuation, because of the possibility of locking regulating element 61.

A further simplified switching device 8 particularly suitable for actuation by a servicing trolley 70 is described with reference to FIG. 3. Regulating element 81 is displaceably mounted in a housing 80. Housing 80 is closed on two sides thereof by covers 82 and 83. Located between cover 82 and regulating element 81 is a spring element 84 which biases regulating element 81 towards cover 83. Cover 83 has a central bore 830, through which extends a regulating bolt 810 of regulating element 81.

Regulating element 81 has two control bores 811 and 812. Control bore 811 connects two pipe connections 500 and 501 to one another whenever spring element 84 is relaxed. Pipe connections 500 and 501 serve to connect first suction line 50 to switching device 8. Second control bore 812 in the other end position of regulating element 81 connects together two pipe connections 510 and 511 which serve to connect second suction line 51 to switching device 8.

In its spinning position, regulating element 81 is as illustrated in FIG. 3 wherein control bore 811 is in operative association with suction line 50 which is associated with fiber-collecting surface 33 for maintaining suction in spinning rotor 30. During such time, no suction is provided at sucking-off orifice 52. Fibers 47 thus arrive at fiber-collecting surface 33 in the spinning rotor 30 as a result of such spinning suction controllably provided in spinning rotor 30.

To bring regulating element 81 into its complete fiber discharge position, in which suction at fiber discharge orifice 130 is cut off and instead provided to sucking-off orifice 52, it is sufficient to exert force on regulating bolt 810 and thereby displace regulating element 81 counter to the effect of spring element 84. As a result, control bore 812 comes into operative association with suction line 51. This result provides suction to sucking-off orifice 52, while removing spinning suction in from spinning rotor 30. To obtain return of control slide 81, it is sufficient to release regulating bolt 810 so that spring element 84 can provide force to move regulating element 81 back into the spinning position, as illustrated in FIG. 3.

Even in this embodiment, pressure can be manually exerted on regulating bolt 810. If an automatic mechanism is used for the start of spinning, regulating bolt 810 may be controlled from a movable servicing trolley 70 via an electromagnet (not shown) or via a drive member such as drive bolt 71. If pipe connections 500, 501, 510 and 511 are suitably arranged and regulating element 81 is appropriately controlled from control device 7, switching device 8 can also be switched by gradations, i.e. in discrete incremental movements or the like.

To prevent fibers 47 and yarn residues from becoming clogged within housing 80 and regulating element 81 during sucking-off operation, the provision of the two control bores 811 and 812 ensures that suction air always passes through switching device 8 in a straight line. This desirable phenomenon is achieved because each of suction lines 50 and 51 has assigned to it its own control bore, 810 and 811, respectively, which can be brought in straight line association with pipe connections 500, 501 and 510, 511, respectively.

It is possible that during a given moment of changeover of regulating element 81, one or more fibers 47 may be located at a point of transition from pipe connection 510 into control bore 812 or from control bore 812 into pipe connection 511. It is also possible, though less likely, that at such given moment fibers 47 may be located in a transitional region between pipe connection 500 and control bore 811 or between control bore 811 and pipe connection 501. So that such fibers 47 or yarn ends cannot jam between regulating element 81 and housing 80 at such transitional points, edges 813, 814, 815 and 816 of control bores 811 and 812 and associated edges 800, 801, 802 and 803 of pipe connections 500, 501, 510 and 511 or of housing 80 are made sharp.

In such manner, the stationary edges and the movable edges which can be brought into paired association with them (i.e., 800 and 813, 814 and 801, 802 and 815 and 816 and 803) form respective cutting devices. Thus, during switching of regulating element 81, fibers 47 and yarn residues located in the region of such cutting devices are severed, so that some of them remain within control bore 811 or 812 while others remain within suction line 50 or 51. Regulating element 81 is thus reliably prevented from jamming.

In an analogous manner, the interacting edges of switching device 64 (FIG. 1) or device 6 (FIG. 2) of suction lines 50 and 51 or of connection pieces (not shown) assigned to same, can also be formed as such paired cutting devices.

Further modifications are possible, with above features being interchanged or replaced by equivalents and combinations thereof, and all such modifications and variations come within the scope of the present invention. For example, in the constructions of a device for starting spinning which are explained with reference to FIGS. 1 and 2, two suction lines 50 and 51 are connected to a common suction source 5 or to a common suction channel 53. If desired, there may of course also be provided separate suction sources for each respective suction line. In such case, suction lines 50 and 51 may be connected to such separate suction sources by means of separate switching devices in ganged coordination (or otherwise cooperatively controlled) or by a common switching means such as devices 64, 6 or 8. Such specific variation is more readily envisioned when FIG. 3 is considered.

A direct and relatively simple drive from a servicing trolley 70 is also possible with a switching device 64 designed as a rotary valve (such as in FIG. 1), particularly if the switching device has a regulating bolt which projects radially outwards and which can be thrust in a given direction by a drive bolt of the servicing trolley (such as drive bolt 71 of FIG. 2). Return thereof may be effected by means of a spring element embodied as a torsion spring.

Figure 4:
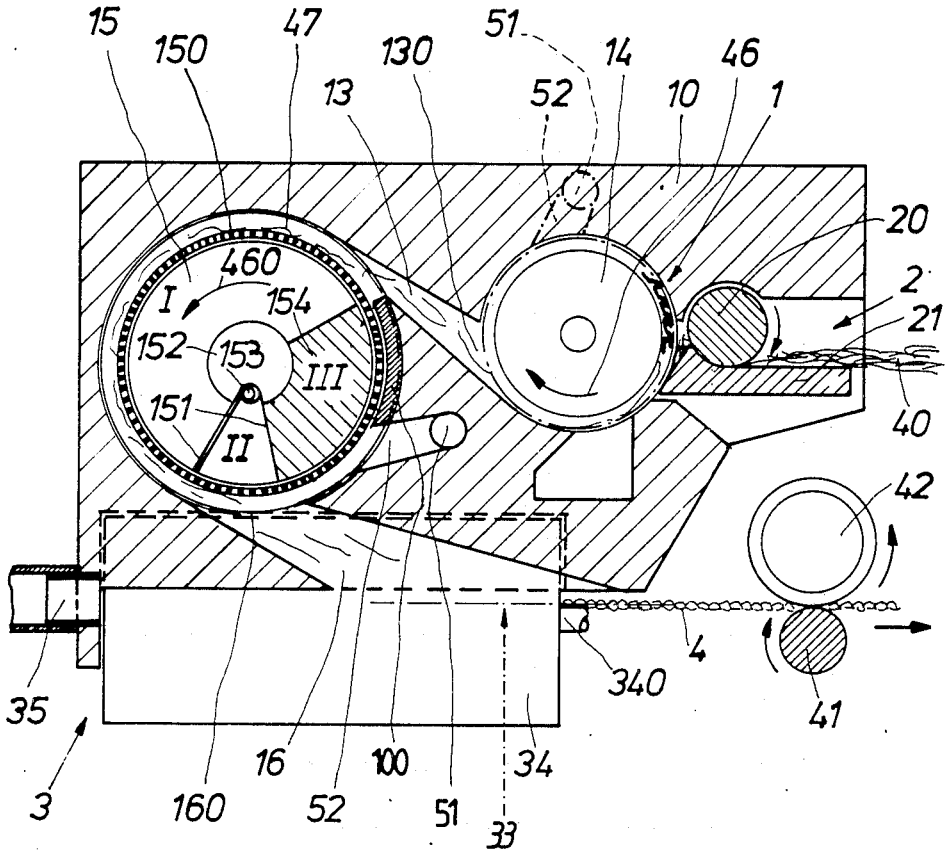
FIGS. 4 and 5 illustrate, in section and diagrammatic cross-section, respectively, modifications and alternative embodiments of an open-end spinning apparatus according to this invention.

FIG. 4 illustrates an exemplary open-end spinning apparatus having friction rollers 34. Use of several rollers can ensure proper transport of fibers to be spun instead of an opening roller 11. First roller 14 opens the fiber material to be spun and is therefore designated as an opening roller. Second roller 15, mounted rotatably between opening device 1 and friction rollers 34, is disk-like and has a collecting surface 150 about its periphery. Collecting surface 150 is connected to opening device 1 via a feed channel 13 which opens onto the collecting surface approximately tangential to the direction of the rotary movement of such surface. The width of channel 13 generally matches that of collecting surface 150.

Roller 15 is mounted on a hollow axle 152, journaled in a frame of the spinning machine and extending in a plane perpendicular to axles 340 of friction rollers 34. Roller 15 is driven in the direction indicated by arrow 460. For the sake of clarity, roller 15 is illustrated as a relatively long distance from the gusset region of friction rollers 34 (i.e., the generally v-shaped area where such friction rollers oppose each other). However, in a practical embodiment, roller 15 should extend as far as possible into such gusset region so that the path of fibers from collecting surface 150 into the gusset region is as short as possible.

A controllable suction-air nozzle 35 is located on the side of the gusset region of friction rollers 34 which faces away from draw-off rollers 41 and 42.

During their transport to friction rollers 34, fibers are retained on the perforated collecting surface 150 of roller 15 by means of a suction-air stream. For this purpose, disk-like roller 15 is connected via its hollow axle 152 to a suction device (not shown). However, the suction-air stream acts only on a sectional portion I of collecting surface 150, extending in the direction of rotation of roller 15 from a point where fibers are fed onto collecting surface 150 up to their strip-off point predetermined by a transfer sector II (illustrated in FIG. 4). The transfer sector II is kept separate from the suction-air stream by means of paired partition walls 151. This permits fibers 47 to be loosened and hence removed from collecting surface 150. Opposite transfer section II, housing 10 has a mouth 160 of a fiber feed channel 16 which leads to friction rollers 34.

It is advantageous to pneumatically (or otherwise) assist and speed up the stripping off of fibers from the collecting surface, thereby ensuring that all of the fibers formerly on such surface pass into the spinning gusset formed by rollers 34. To obtain such result, an air stream flowing through the collecting surface towards friction rollers 34 is introduced into sector II. Since at least one of the friction rollers is subjected to suction and since housing 10 extends over the friction rollers 34 in such a manner to seal same, such flow desirably arises as a result of the suction of air from sector II. The required air is supplied through a pipeline 153, which is inserted into hollow axle 152 and which communicates sector II with the atmosphere.

Should such communication be insufficient, pipeline 153 can further be operatively associated with a compressed-air device, while collecting surface 150 is subjected to a slight excess pressure in the region of sector II. In addition to the aforementioned retention of fibers on the fiber collecting surface by pneumatic means during their transport (or even independently of this), fibers may also be retained on surface 150 mechanically, e.g. by means of needles or the like (not shown) arranged about the periphery of surface 150.

To prevent anomalous or unwanted air flows in the region where fibers 47 are fed to collecting surface 150, and to expose fibers 47 conveyed through fiber feed channel 13 solely to an air stream which stretches them and ensures that they are deposited on collecting surface 150 with the correct orientation in their direction of movement, a sector III, contiguous with sector II and extending up to the mouth of fiber feed channel 13, is kept free of fiber flow by means of a fixed diaphragm 154. Furthermore, a peripheral wall 100 radially adjacent collecting surface 150 is provided in the region of sector III. Sucking-off orifice 52 is disposed within peripheral wall 100, outside the fiber transport path but between fiber discharge orifice 160 and fiber feed channel 13.

For spinning operation, fiber material is supplied as a sliver 40 to opening roller 14 by a delivering roller 20 via feed trough 21. Opening roller 14 separates sliver 40 into individual fibers 47. The above-described suction in sector I of roller 15 produces a transporting air flow which transports separated fibers 47 through feed channel 13 to collecting surface 150, where they are deposited.

Fibers 47 being doubled and fed onto rotating collecting surface 150, are transported on surface 150 over its sector I, in which they are retained pneumatically and/or mechanically as described above, to mouth 160 of feed channel 16. Since collecting surface 150 moves along the thread draw-off direction in the gusset region, retained fibers are fed in transfer sector II into the gusset region parallel to the thread axis. In the gusset region, such fibers are tied to a rotating open thread end and twisted into a thread 4.

When a thread break occurs, the supply of fiber material to opening roller 14 is interrupted due to automatic stoppage of feed device 2. Also, suction otherwise provided in friction rollers 34 is cut off. In preparation for the operation of starting spinning, the thread end is returned into the spinning gusset of friction rollers 34, with an assist by a suction-air stream which is activated within suction-air nozzle 35. Feed device 2 is then switched on. So that fibers 47 are prevented from reaching friction rollers 34 during such time, suction is provided at sucking-off orifice 52 on the periphery of roller 15 via suction line 51. Consequently, the airstream flowing into transfer sector II through pipeline 153 is guided into sucking-off orifice 52. Fibers 47 fed to collecting surface 150 by roller 14 follow such airstream and are thus sucked into suction line 51. At a specific moment synchronized with return of the thread, suction in suction-air nozzle 35 and in suction line 51 is cut off, and instead suction in one or more of friction rollers 34 is provided. Thread 4 is drawn off from the spinning gusset of friction rollers 34, with the fibers 47 then being supplied to the spinning gusset again being tied in at the same time.

In a construction such as the exemplary device illustrated in FIG. 4, the fiber stream may also be controlled as a result of the above-described switching of the airstream. Certain of the fibers 47 not required whenever the spinning process is interrupted are discharged before they reach the spinning unit. When spinning starts, only newly supplied fibers (which are undamaged) arrive at the spinning unit. Thus, the thread 4 produced has high strength even in the regions of its joins.

In an alternative embodiment represented by dot-and-dash lines in FIG. 4, sucking-off orifice 52 can be arranged in peripheral wall 101 of opening roller 14 after (i.e. downstream from) mouth 130 of feed channel 13, instead of in peripheral wall 100 of roller 15. To make it impossible in such alternative embodiment for fibers 47 to reach collecting surface 150 of roller 15 whenever suction is provided at orifice 52, suction in sector I of second roller 15 is controlled in synchronism with the suction in friction rollers 34. Thus, when fibers 47 are to be sucked off through orifice 52 in the peripheral wall of roller 14, suction is provided in orifice 52 but removed in sector I of roller 15 and in friction rollers 34.

To facilitate transfer of fibers 47 from opening roller 14 or roller 15 to their respective following mouths 130 or 160 of respective feed channels 13 or 16, it is also possible for pipeline 153 to be connected either to the atmosphere, a compressed-air source (not shown) or a suction-air source (e.g., suction line 151). For such purpose, an appropriate switching device (such as one of 64, 6 or 8 discussed above), at the time when fibers 47 are to leave roller 15 through fiber discharge orifice 160 in the direction of friction rollers 34, connects pipeline 153 to either the atmosphere or the compressed-air source, while the sucking off orifice 52 is at the same time isolated from suction source 5 and a suction force is provided on friction rollers 34 via suction line 50.

However, when fibers 47 are to leave roller 15 through sucking-off orifice 52, instead of through feed channel 16, the switching device is used to isolate friction rollers 34 from suction source 5. Also, sucking-off orifice 52 following fiber discharge orifice 160 is connected to suction source 5 via suction line 51. To ensure that fibers 47 are retained securely on collecting surface 150 (even in the region of the sector II), pipeline 153 is also at such time connected to the abovementioned suction line 51. Thus, sector II of roller 15 is also subjected to suction whenever sucking-off orifice 52 is provided suction.

Yet a further modification of a device for carrying out the present invention is described with reference to FIG. 5. In this exemplary embodiment, switching device 9 has a diaphragm 90, by means of which mouth 130 of the feed channel 13 can be selectively and controllably covered or exposed. An actuating device 91 (indicated schematically for clarity and since further detail is not required for an understanding thereof) is operatively associated with diaphragm 90. By means of actuating device 91, diaphragm 90 can be adjusted by hand or by means of a drive bolt 71 driven by a drive device 92.

Actuating device 91 may assume any of a number of specific embodiments. For example, it may comprise a two-armed lever, cranked as appropriate, and having a surface which functionally interacts with diaphragm 90, which in turn may be shaped as a slide, or the like. For the return function, a spring element 93 can be associated with diaphragm 90 and a relatively fixed surface in the manner illustrated by FIG. 7.

Diaphragm 90 is arranged essentially as an extension of peripheral wall 101 of opening-roller housing 10. At its end 907 (which is reached first by fibers 47 being transported to sucking-off orifice 52 in the direction of arrow 46), diaphragm 90 is at a greater distance "a" from opening roller 11 than the part of the peripheral wall 101 which (as seen in the fiber transport direction) is arranged in front of 907 (i.e., distance "a 1").

In contrast, the distance "b" between opening roller 11 and end 908 of diaphragm 90 (which is reached last by fibers 47 being supplied to sucking off orifice 52) is less than the distance "b 1" between opening roller 11 and that part of peripheral wall 101 of housing 10 which follows end 908. Furthermore, as illustrated by FIG. 5, terminal end 908 of diaphragm 90 (as considered in the fiber transport direction represented by arrow 46), projects beyond that part of peripheral wall 101 of housing 10 which follows the fiber discharge orifice 130. Thus, diaphragm 90 at its initial (or first) end 907 is overlapped by peripheral wall 101 of opening-roller housing 10 in a manner similar to that of a roofing tile, while the terminal (or second) end 908 of diaphragm 90 overlaps peripheral wall 101 also in a manner similar to that of a roofing tile.

Such relative distances and overlapping features ensure that when mouth 130 is covered, there are no projecting edges on which fibers 47 can catch on or in front of diaphragm 90. Such is true since the fibers, when mouth 130 of feed channel 13 is exposed, could then be passed as fiber lumps into spinning rotor 30 or friction roller 34 and impair the start of spinning.

Figure 5:
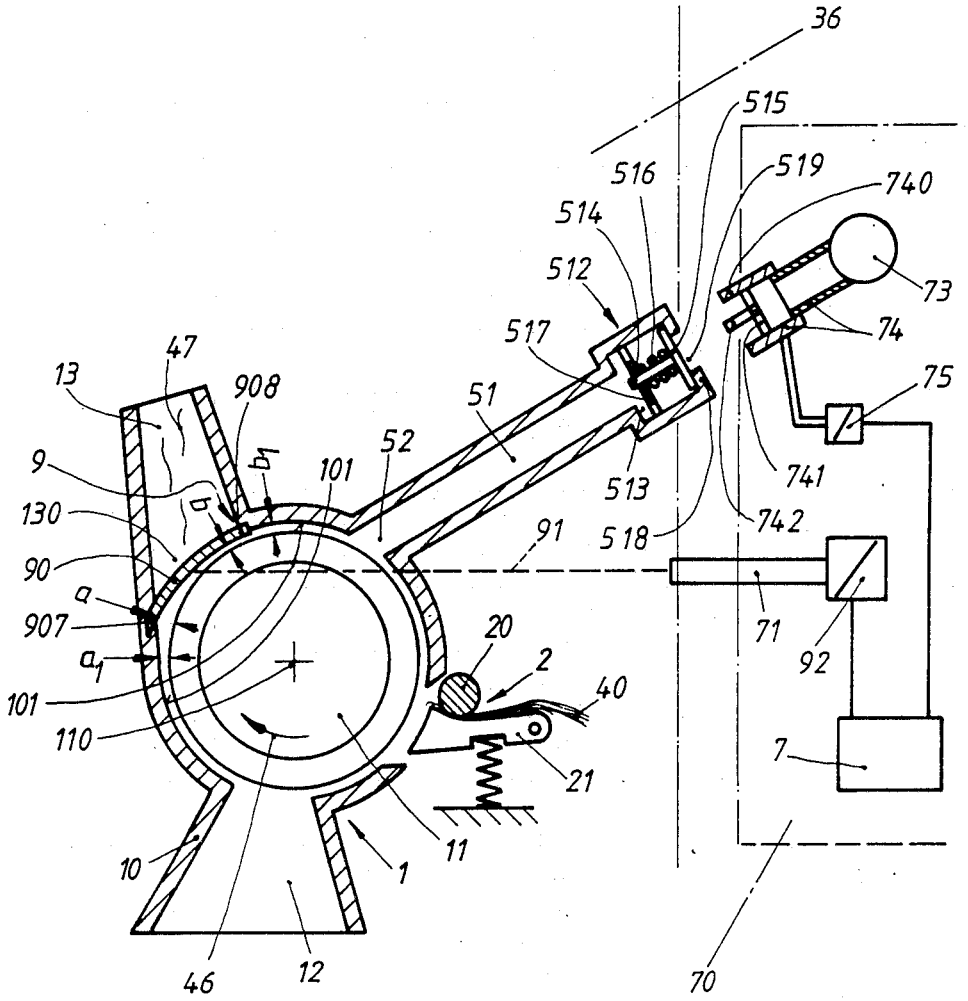

In accordance with FIG. 5, one end of suction line 51 terminates in a switching device 512 which is embodied as a non-return valve, and by means of which suction force in suction line 51 can be controlled. In the exemplary construction illustrated, the non-return valve is located in chamber 513 which is itself arranged at the end of suction line 51 which faces a servicing trolley 70, which is movable alongside spinning machine 36, as discussed above.

An axial guide 514 for valve cone 515 is arranged centrally within chamber 513. Valve cone 515 has biasing force applied thereto by means of spring element 516, which is supported at one of its ends on spokes 517. Such spokes provides a rigid connection between guide 514 and the peripheral wall of chamber 513. The side of chamber 513 which faces servicing trolley 70 has an orifice 519 which is surrounded by a valve seat 518, and which can be controllably closed or opened to varying degrees by means of valve cone 515.

In addition to suction source 5 provided within the structure of spinning machine 36, a second suction source 73 is associated with servicing trolley 70. A telescopic suction-air line 74 extends from suction source 73 towards spinning machine 36. A drive device 75 is operative with telescopic line 74 to controllably bring the mouth 740 of line 74 into sealing relationship with the wall of chamber 513 which faces the servicing trolley 70, or alternatively to controllably retract same therefrom. A pin 742 retained by spokes 741 in mouth 740 of line 74 projects axially beyond mouth 740 and in the direction of spinning machine 36. Contact of mouth 740 with chamber 513 holds valve cone 515 at a distance from its valve seat 518 and thus opens the valve.

During normal spinning, closing member 90 exposes mouth 130 of feed channel 13, while at the same time switching device 512 (embodied as a non-return valve) assumes its closing position. Fibers 47 thus pass through mouth 130 of feed channel 13 and onto fiber-collecting surface 33 of spinning rotor 30 or of friction rollers 34, where they are tied into the end of thread 4.

If the thread 4 breaks, spinning rotor 30 is stopped via a thread monitor (not shown), and the supply of fibers to opening roller 11 is suspended while the spinning suction in spinning rotor 30 is maintained.

After the particular spinning station where such a thread break occurred has been reached by servicing trolley 70, the trolley actuates the diaphragm 90 by means of drive bolt 71 operating on actuating device 91, thereby pushing diaphragm 90 into its closed position. In such position, mouth 130 is effectively closed off from the interior of housing 10 where opening roller 11 is received.

Spinning rotor 30 is then cleaned in a known way under the control of servicing trolley 70, and the thread end is prepared such that it has a favorable form for the subsequent start of spinning. Spinning rotor 30 is then released and runs up to its normal spinning operation rotational speed. During such running up or after the usual steady-state operating speed of the rotor has been reached, the thread end is returned in the customary way to a stand-by position in the thread draw-off tube 32 (FIG. 1) so as to form a thread reserve. In such position, the suction exerted on housing 31 becomes effective as before the thread break and resulting re-threading operation.

Mouth 130 of feed channel 13 is then covered. Also, as a result of the action of connecting suction-air line 74 so as to extend from suction source 73 to switching device 512, switching is performed so that the suction force generated by suction source 73 is now provided at sucking-off orifice 52. Feed device 2 may then be switched on again. Fibers 47 supplied to opening roller 11 are thus conveyed beyond covered mouth 130 to sucking-off orifice 52 and from there pass via suction line 51, chamber 513 and suction-air line 74 to suction source 73 of servicing trolley 70.

Fibers 47, which have or may have previously been damaged because of being shaved off by the running opening roller 11 while the feed device 2 has been stopped, are thus discharged and do not enter spinning rotor 30.

Synchronously in time with the thread return, drive bolt 71 again releases actuating device 91 which returns diaphragm 90 into its basic position (i.e., mouth 130 of feed channel 13 being exposed). Fibers 47 then are free to enter spinning rotor 30, where they are subsequently tied to the thread end which has in the meantime entered spinning rotor 30 because of the thread reserve being used up. Thread 4 may then be drawn off again from spinning rotor 30 in a known way be means of draw-off rollers 41 and 42 and bobbin 44 (illustrated in FIG. 1). At the same time, the new fibers 47 arriving at fiber-collecting surface 33 are also being tied in to the continually produced thread.

It is not necessary that diaphram 90 reach into feed channel 13 to spinning rotor 30 or onto friction roller 34 in a single, uniform pushing action. As described with reference to the example of FIG. 1, a substantial improvement in the thread join can be achieved as a result of a gradual switching of the fiber stream. It has been shown that the fiber stream can be controlled even more directly and accurately if mouth 130 of feed channel 13 is controllably covered and exposed, instead of controlling the suction conditions in suction lines 50 and 51. In such a case, there would be no need for control of suction force in either of suction line 50 or in suction line 51.

Figure 6:
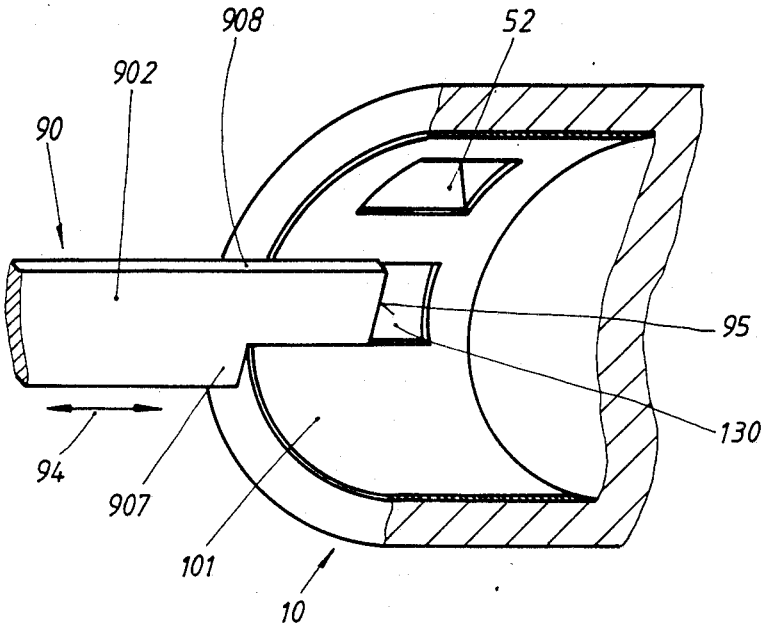
FIGS. 6 and 7 illustrate, in diagrammatic plan view, a housing of an opening roller with two separate embodiments of a switching device according to the invention.

Gradual switching of a fiber stream from sucking-off orifice 52 to fiber discharge orifice 130 can therefore be carried out when edge 95 of diaphragm 90 exposes mouth 130 in gradations or steps (see FIG. 6). So long as mouth 130 of feed channel 13 is covered, all of fibers 47 pass through sucking-off orifice 52 and into suction line 51. When mouth 130 is partially covered as a result of the displacement of diaphragm 90, some of fibers 47 transported by opening roller 11 enter mouth 130 and therefore also enter spinning rotor 30. However, whenever mouth 130 of feed channel 13 is partially covered in this way, the effect of spinning suction at mouth 130 is reduced such that the rest of the fibers 47 transported by opening roller 11 arrive as before at sucking-off orifice 52, where a suction force is provided which is higher than that at mouth 130.

Since the fibers 47 are not very inert but instead are fairly mobile, more of them pass into fiber discharge orifice 130 than just those which are guided over the actual opened region of mouth 130 by the airstream rotating together with opening roller 11. In fact, even fibers 47 located above the covered region of mouth 130 are sucked up and carried along by the suction-airstream leaving mouth 130 of feed channel 13. The proportion of fibers 47 passing through mouth 130 is thus higher than that which would correspond to the degree of opening of the fiber discharge orifice 130. However, the fiber stream can nevertheless be divided up easily and reliably in such manner.

Depending on the particular intermediate position selected for the subject switching device (i.e., depending on the suction forces present in the region of mouth 130 of feed channel 13), the proportion of fibers 47 passing through mouth 130 into spinning rotor 30 or to friction roller 34 may be higher or lower. The division of the fiber stream can therefore be more accurately controlled by means of diaphragm 90 depending upon the nearness of such control element to the fiber/airstream rotating together with the opening roller 11. In addition to preventing accumulations of fibers in front of diaphragm 90, the foregoing "nearness" consideration provides another reason why it is preferred that diaphragm 90 should, if possible, form an extension of the peripheral wall of housing 10.

So that fibers cannot become jammed even in lateral guide slits, feed channel 13 (on its side facing the spinning unit) may be provided in the region of diaphragm 90 with a sudden increase in channel diameter such as is known in subdivided fiber feed channels.

Finally, when the entire fiber stream reaches the spinning unit (either spinning rotor 30 or friction rollers 34), the suction air stream effective in sucking-off orifice 52 is of little significance. Generally, it no longer has any influence on fiber transport. To save energy costs entailed in the generation of suction, after the end of the operation to start spinning, suction behind mouth 130 (i.e., in suction line 51) is cut off by means of switching device 512. To obtain such function in the exemplary construction illustrated in FIG. 5, servicing appliance or trolley 70 retracts its suction-air line 74 at least far enough for pin 742 to release valve cone 515. Valve cone 515 is thus brought up against its valve seat 518 by the biasing force of spring element 516. Orifice 519 is therefore closed so that air cannot flow through such orifice 519 in either direction. Consequently, air which could otherwise disturb the fiber transport and spinning process does not enter opening roller housing 10.

As illustrated by FIG. 6, mouth 130 of feed channel 13 may be closed by bringing solid region 902 of the slide-like diaphragm 90 sufficiently over mouth 130 so as to close same.

As explained above, mouth 130 is closed whenever the supply of fibers is stopped, so that there is no risk that fibers 47 will become jammed. Nor is there any danger that fibers will become jammed when mouth 130 is exposed.

To avoid the aforementioned second thick portion which usually arises when thread is pieced up by prior art methods or devices, and without the need to accept a thin portion directly after a thread join, control device 7 acts via drive device 92 on diaphragm 90 in such a manner that the diaphragm is moved in a non-uniform (or non-linear) way whenever it is brought into its position which exposes mouth 130. This may be achieved in different ways, for example by means of a continuous, but non-uniform movement or by means of a series of discontinuous movements.

Since the gradual switching of the fiber stream does not depend only on the degree of opening of mouth 130, but also on a utilization of the inertia possessed by fibers 47, a more accurate division of the fiber stream can be obtained if diaphragm 90 is made movable parallel to axle 110 of opening roller 11, as is illustrated in the exemplary constructions of FIGS. 5 and 6 (see arrow 94).

The exemplary device described with reference to FIG. 6 presupposes a non-uniform movement of diaphragm 90 to achieve gradual switching as discussed above. To obtain desired fiber flow into spinning rotor 30 (or to friction roller 34) even when diaphragm 90 is actuated for uniform movement, a control orifice 900 may be provided for diaphragm 90. Orifice 900 has between its region 901 (which completely covers mouth 130) and its region 902 (which completely exposes mouth 130) a profile corresponding to the desired flow of the fiber stream in the feed channel 13 (see FIG. 7) as determined by the degree of opening of mouth 130.

Figure 7:
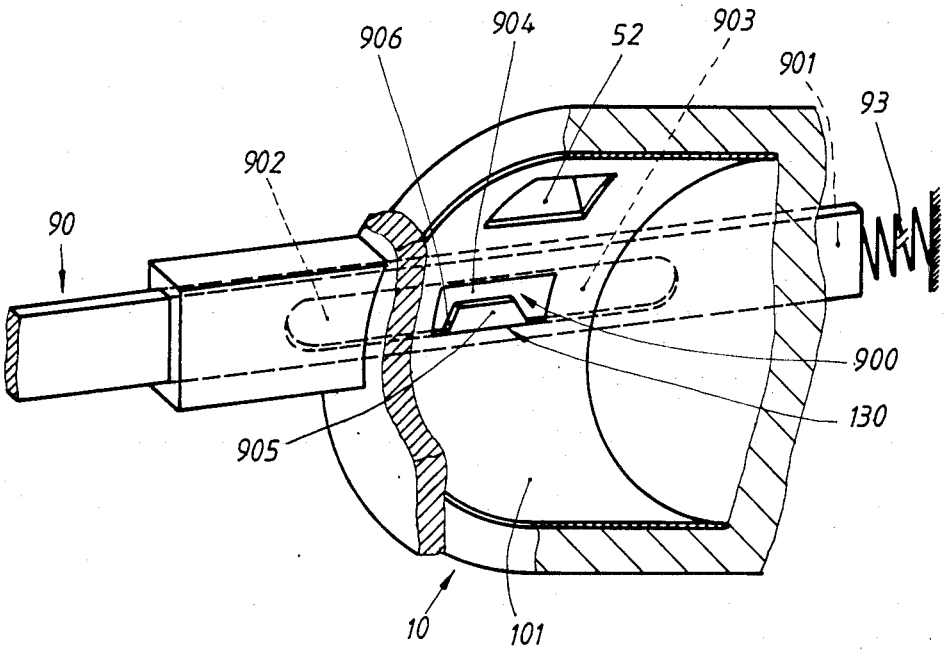
Figure 8:
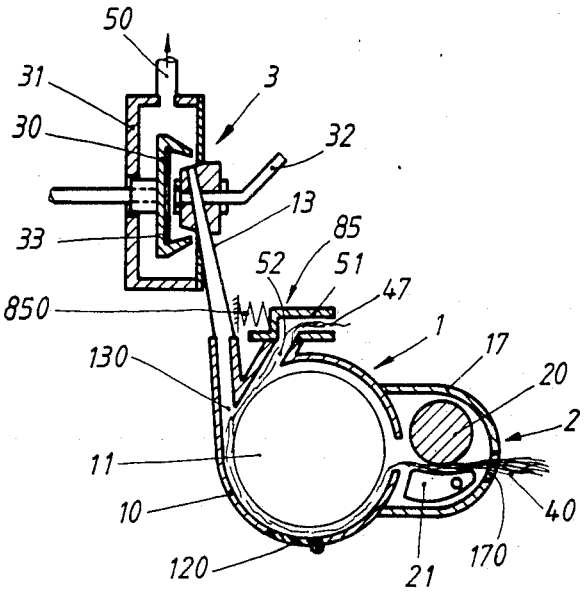
FIGS. 8–12 illustrate, in diagrammatic side views, different stages of operation of yet another embodiment of an open-end spinning apparatus in accordance with the teachings of this invention.
Figure 9:
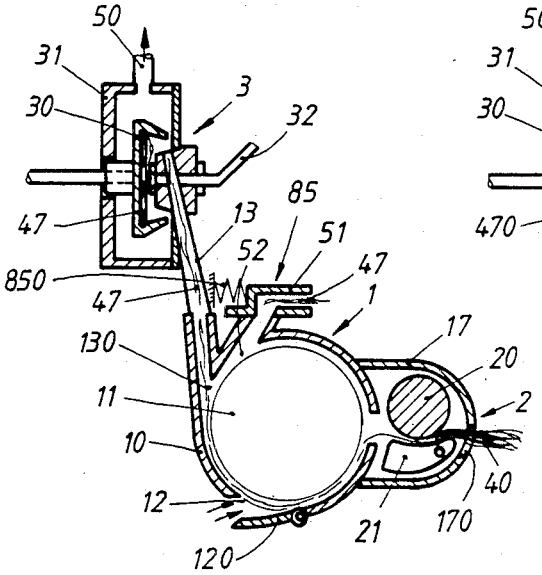
Figure 10:
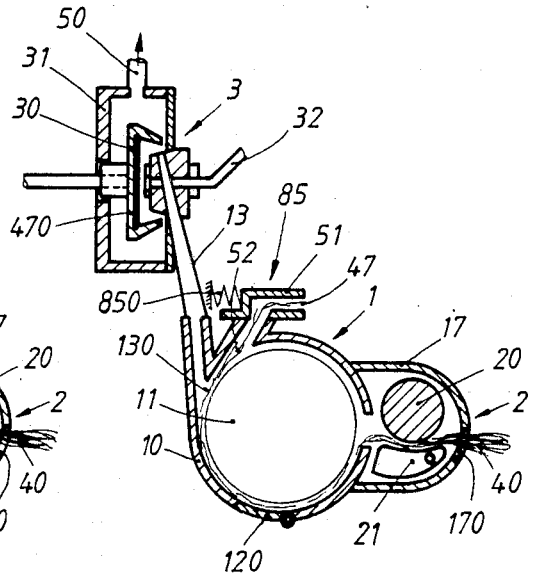
Figure 11:
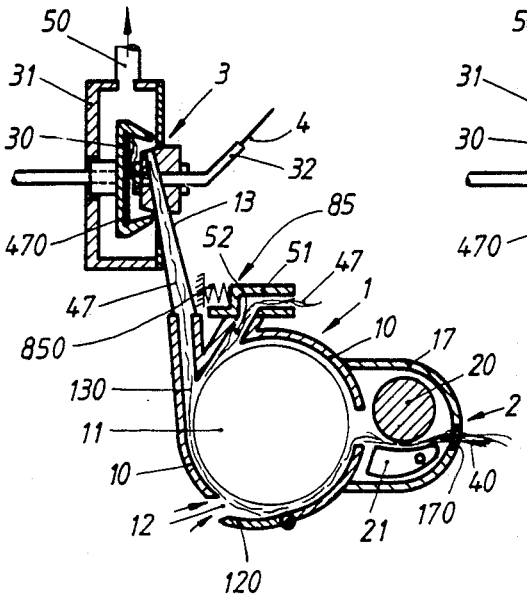
Figure 12:
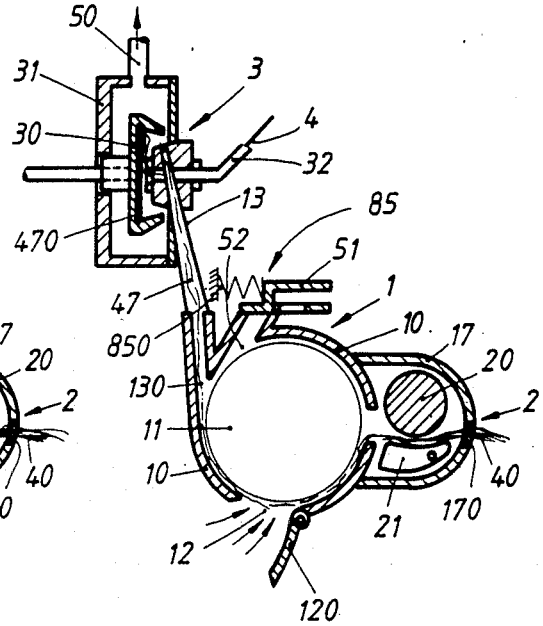

As illustrated by FIG. 7, control orifice 900 has a region 903 which is adjacent to its region 901 and which exposes mouth 130 completely. Furthermore, adjacent to this region 903 is a region 904 which, as a result of a profile provided in a nose pattern 905, exposes only a reduced cross-section of mouth 130. These regions are yet adjacent a further region 902 which, when opposite mouth 130, permits same to be completely exposed during the spinning process.

To prepare for the start of spinning, mouth 130 is covered so that the fiber stream may be guided beyond mouth 130 of feed channel 13. Caused by drive bolt 71, lifting movement of diaphragm 90 and its region 903 (illustrated in FIG. 2) causes mouth 130 to become increasingly opened until it is exposed completely. A large number of fibers 47 thus pass rapidly into spinning rotor 30. Synchronously in time with the supply of fibers to spinning rotor 30, spinning is started and thread 4 is drawn off again.

So that a large number of fibers 47 will not be laid onto the fiber ring after the start of spinning, the supply of fibers to spinning rotor 30 is temporarily throttled by means of nose 905 (forming an integral part of diaphragm 90) as a result of a reduction in the open cross-section of mouth 130. With a rapid increase in thread draw-off speed, the desired fully quantity of fibers can subsequently enter spinning rotor 30 because the mouth 130 is properly exposed, as illustrated in FIG. 7.

Depending on the periodic or time-changing thread draw-off speed, a flatter or steeper curve may be provided for the profile of edge 906 of nose 905. Such profile, irrespective of whether it is a nose 905 or not, can have a straight or curved form so as to increasingly expose the orifice cross-section with movement of the diaphragm.

Particularly inconspicuous thread joins may be obtained by briefly interrupting the fiber stream supplied to fiber-collecting surface 33 through feed channel 13 (with the fiber stream being temporarily discharged via sucking-off orifice 52 for such), and then supplying the fiber stream to fiber-collecting surface 33 again after the thread end has reached surface 33 and thread 4 has begun to be drawn off again. The desired interruption may be achieved through various means in accordance with the present invention, for example, by means of a particular shaping of orifice 900 or appropriate control of the movement of diaphragm 90.

Yet another exemplary embodiment of a spinning apparatus in accordance with the present invention is described with reference to FIGS. 8 through 12. In this construction opening-roller housing 10 is closed against inflow of air about the region of feed device 2. Housing 17 thereof has only one sliver feed orifice 170, but it does not allow uncontrolled air flow into or out of housing 10 through such orifice.

A switching device 85 is provided in suction line 51 to controllably shut off and open line 51. Switching device 85 may comprise any of various suitable constructions, such as a slide valve stressed into a closing position by a spring element 850 and brought into an opening position with connection to suction line 51 of a suction-air nozzle 74 (illustrated in FIG. 5) which may be arranged on servicing trolley 70. Furthermore, dirt separation orifice 12 may be provided with closing member 120, which may comprise, for example, a flap.

A device constructed in accordance with the present embodiment can reroute a fiber stream in a direct and relatively simple way, even without having to control the suction within housing 31. Suction line 51 is connected to a suction source (for example, source 73 an servicing trolley 70) which has suction power higher than that of the spinning suction. When suction-air line 74 is brought into operative association with suction line 51, switching device 85 is brought into its through-flow position, which is counter to the force exerted by spring element 850.

When flap-like closing member 120 is closed, required air can be brought into housing 10 through the only remaining orifice, namely mouth 130 of feed channel 13. To prepare for the start of spinning, and as a result of the closure of the closing member 120, a suction flow is generated on the periphery of the opening roller such that the air flow is reversed even though the spinning suction remains unchanged. The airstream thusly generated flowing from feed channel 13 into sucking-off orifice 52 also carries with it fibers 47 transported by opening roller 11 (refer to FIG. 8).

Subsequently, as a result of a partial opening of flap-like closing member 120, the effect of the suction prevailing at sucking-off orifice 52 is reduced to such an extent that the fiber stream is divided. Some of the fibers 47 thus pass as before into sucking-off orifice 52, while other fibers pass through mouth 130 of feed channel 13 onto fiber-collecting surface 33. Depending on the degree of opening of member 120, the airstream in feed channel 13 is reversed to a varying extent. Hence, the proportion of the fiber stream fed to fiber-collecting surface 33 can be fixed by the degree of opening of closing member 120 (refer to FIG. 9).

When sufficient fibers 47 have been supplied to fiber-collecting surface 33 in such manner (eg. so as to form a fiber ring 470 in spinning rotor 30), other inflows of air into opening-roller housing 10, with the exception of the air flow presently generated in the feed channel, are again cut off. Fibers 47 are therefore again sucked off through sucking-off orifice 52 by means of the air flowing in feed channel 13 (refer to FIG. 10).

Thread 4 may then be fed to spinning rotor 30. Synchronously in time with this, closing member 120 is moved in a non-uniform (eg. non-linear) way so as to expose dirt separation orifice 12 according to the desired flow of the fiber stream in feed channel 13 (refer to FIG. 11). This control is effected by means of a suitable control device which may be, for example, arranged on a servicing trolley and which effects via a drive device (such as 92) a flap-like closing member 120 (refer to FIG. 5). Control is carried out in such a way that thick portions and thin portions, both in the thread join itself and in the thread piece adjoining it, are avoided, as explained in detail, above, and throughout this specification.

Ultimately, closing member 120 is arranged in its fully open position as thread draw-off reaches its full speed. As a result of the de-coupling of suction-air line 74 from suction line 51, switching device 85 is released, which shuts off the connection between suction channel 51 and sucking-off orifice 52 by the action of spring element 850. Thus, no air can flow into opening roller housing 10 during normal spinning process (illustrated by FIG. 12).

The progression of FIGS. 8 through 12 (and their related discussion) illustrates the controllable effect which the position of flap member 120 has on the fiber stream flow within spinning machine 1.

However, the air inflow for controlling the fiber stream can be controlled at any of various locations on opening roller housing 10, or even on housing 17, which is associated with feed device 2. If a dirt separation orifice 12 is provided, as in the exemplary embodiment illustrated, it may advantageously also comprise the air-inflow orifice for controlling the fiber stream. After spinning has started and after suction channel 51 has been closed off, the dirt separation orifice can then be selectively opened or closed as desired, depending on whether dirt is to be extracted or not.

In the exemplary embodiment described, closing member 120 is located at a non-critical point on the fiber transport path. No fibers 47 escape from opening roller housing 10 because they have not yet reached a sufficiently high centrifugal force at that point on roller 11.

As described above, housing 17 in cooperation with closing member 120 make it impossible for other air flows to enter opening roller housing 10 except through feed channel 13. Consequently, the fiber stream reacts in a highly sensitive way to suction changes within suction channel 51. This makes it possible, even when there is no dirt separation orifice 12 in opening roller housing 10, to control the fiber stream accurately by means of a relatively slight change of suction in suction channel 51.

Suction in suction channel 51 or the position of flap-like closing member 120 can be controlled from a servicing trolley 70 in the manner described with reference to the examples of FIGS. 2, 3 and 5.

Figure 13:
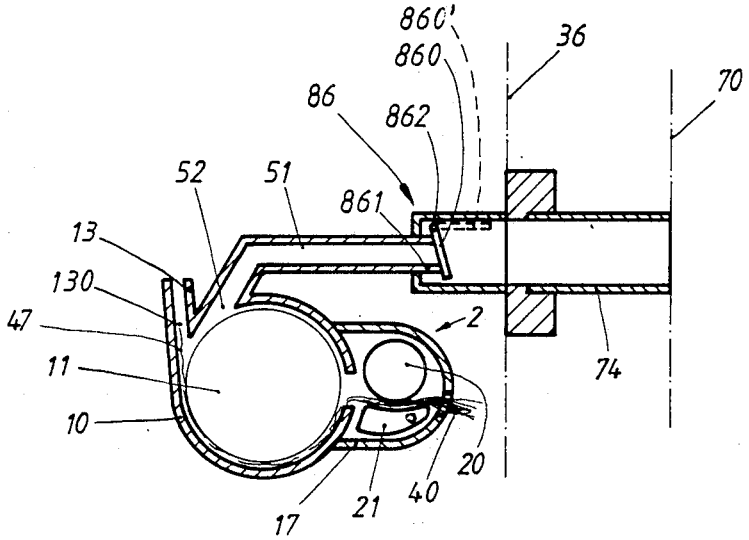
FIG. 13 shows, in diagrammatic side view, an open-end spinning apparatus having a modified switching device.

Yet another construction of a switching device 86 in accordance with this invention is illustrated in FIG. 13. Instead of a switching device 85 resembling a slide valve (as illustrated in FIGS. 8 through 12), a flap 860 is articulated above mouth 861 of suction line 51. Mouth 861 faces servicing trolley 70, and forms an inclined valve seat which flap 860 may come sealingly up against as a result of its own weight. Flap 860 and mouth 861 of suction line 51 are located within a chamber 862, which is open on its side which faces servicing trolley 70. From servicing trolley 70, mouth 740 of suction-air line 74 can be brought into sealed relationship with the open side of chamber 862, as indicated by the broken lines of FIG. 13.

So long as suction-air line 74 is not resting against chamber 862 or there is no suction prevailing within line 74 if it does rest against the open side of chamber 862, flap 860 assumes the position represented by its solid line representation in FIG. 13, with the sealing contact between flap 860 and the mouth 861 being further assisted by the suction prevailing within opening-roller housing 10. When suction is exerted via suction air line 74 after mouth 740 thereof has been operatively associated with chamber 862, flap 860 is lifted off from mouth 861 to its new position 860' (illustrated by broken lines in FIG. 13) and the fiber stream is permitted to enter suction-air line 74.

Even though the devices illustrated in FIGS. 5 through 13 have been described solely with reference to the example of opening rollers 11, they may also optionally be used in conjunction with an additional roller 15, as illustrated by the example of FIG. 4.

A switching device 512 or 86 designed as a non-return (i.e., one-way) valve, and intended for controlling suction within suction line 51, has been described above. However, it is possible and within the scope of this invention to provide on a spinning machine a shut-off valve which is actuated from a servicing trolley, and which selectively either connects or does not connect suction line 51 to a suction source which is provided on the spinning machine itself and which is independent of suction source 5. It is also possible, from the servicing trolley, to actuate a switch by means of which a fan is switched on or off. Likewise, suction-air line 74 can be connected via a servicing trolley to a suction source provided on the spinning machine. In general principles in accordance with this invention, the fiber stream can be controlled by means of a change in suction conditions, which may relate to the spinning suction, the sucking-off suction, or both being changed.

While several exemplary embodiments have been disclosed in detail, it is to be understood that all modifications thereto and variations thereof are intended to come within the spirit and scope of this invention. Further, the specific words used are intended only as words of description, rather than words of limitation, such words being found only in the appended claims.

We claim:

1. A method for preparing for and subsequently starting spinning on an open-end spinning apparatus such that a thread end is returned to a fiber-collecting surface and subsequently drawn off with fibers tied thereinto continuously; said apparatus having: a feed device for supplying a sliver; an opening means for receiving said sliver and opening same into separated fibers along a fiber transport path thereof, the flow of which collectively comprises a fiber stream; a fiber-collecting surface for thread formation derived from opened fibers collected thereon; and feed channel means providing passage of opened fibers from said opening means to said fiber-collecting surface; wherein said method comprises the steps of:

(a) preparing for the starting of spinning, including
  (1) actuating said feed device for supplying said sliver,
  (2) deflecting at least a portion of said fiber stream away from said fiber-collecting surface and away from a mouth of said feed channel means, and
  (3) providing a loose thread end to said fiber-collecting surface; and (b) starting actual spinning operation, including
  (1) terminating said deflecting so that said fiber stream is supplied to said fiber-collecting surface, and (2) drawing off said thread end from said surface, with opened fibers of said fiber stream supplied thereto being continuously tied therewith by action of said fiber-collecting surface so that a continuous thread is produced by said spinning apparatus from said previous thread end and said opened fibers supplied to said surface.

2. A method in claim 1, wherein said preparing step includes reducing the effect of spinning suction present at said mouth of said feed channel means to facilitate fibers being guided there-beyond; and said starting step includes deactivating suction provided outside said fiber transport path on the periphery of said opening means and, instead, restoring spinning suction at said mouth of said feed channel means to full effect.

3. A method as in claim 2, wherein said step of reducing the effect of spinning suction at said mouth of said feed channel means includes cutting off said spinning suction.

4. A method as in claim 2, wherein said step of reducing the effect of spinning suction at said mouth of said feed channel means includes selectively and controllably covering said mouth at least partially.

5. A method as in claim 1 wherein, at said starting of actual spinning operation, said step of terminating the deflecting of said fiber stream is effected gradually so that said fiber stream gradually enters said feed channel means and controllably increases up to a predetermined thickness.

6. A method as in claim 2, wherein said step of restoring spinning suction at said mouth of said feed channel means is effected gradually over a period of time relative suction provided outside said fiber transport path so that said fiber stream gradually enters said feed channel means and controllably increases up to a predetermined thickness.

7. A method as in claim 5, wherein said increase of the rate of entry of said fiber stream into said feed channel means is a function of increase in the thread draw-off speed of the spinning apparatus.

8. A method as in claim 5, wherein:

in said starting step, only a small proportion of fibers are initially fed to said fiber-collecting surface, while the complementary proportion of said fibers are guided beyond said mouth of said feed channel means, and wherein said starting step further includes returning said thread end to said fiber-collecting surface, and subsequently increasing the proportion of fibers fed to said fiber-collecting surface after fibers located on said fiber-collecting surface have been tied in to said returned thread end.

9. A method as in claim 1, wherein said deflecting substep of said preparing step includes:

first guiding said fiber stream beyond said mouth of said feed channel means, subsequently supplying said fiber stream briefly to said fiber collecting surface, and then again guiding said fiber stream beyond said mouth of said feed channel means, whereby said fiber stream is subsequently supplied to said fiber-collecting surface only after said thread end has reached said fiber-collecting surface and thread has begun to be drawn off therefrom.

10. A method as in claim 2 wherein, said preparing step further includes generation of a suction flow on the periphery of said opening means such that, with said spinning suction remaining unchanged, air flow in said feed channel means is at least partially reversed, and the air stream thus generated, on its way from said feed channel means into a sucking-off device provided on said periphery of said opening means, carries at least partially with it fibers transported by said opening means.

11. A method as in claim 10, wherein, to reverse said air flow in said feed channel means, said preparing step further includes the sealing off of any other air inflows into a housing which receives said opening means.

12. A method as in claim 11, wherein said preparing step further includes reactivating said other air inflows in a controlled manner to thereby control the quantity of said fibers in said fiber stream supplied to said fiber-collecting surface.

13. A method as in claim 10, further including the step of cutting off said suction outside said fiber transport path on said periphery of said opening means after completion of the starting spinning operation step.

14. A method as in claim 1, further comprising, whenever a thread break occurs, the steps of:

stopping said feed device, cleaning said fiber-collecting surface, and switching said feed device on again, as said deflecting step guides said fiber stream away from said mouth of said feed channel means where it may be sucked off.

15. A method as in claim 14, wherein:

said preparing step includes:

establishing spinning suction in a housing which receives a spinning rotor of said spinning apparatus, feeding said thread end into said spinning apparatus, without touching said fiber-collecting surface, and subsequently cutting off said spinning suction and instead activating suction outside said fiber transport path on said periphery of said opening means, so that, whenever said feed device is switched on again, said fiber stream is guided beyond said feed channel means mouth and is sucked off; and wherein said starting actual spinning step includes:

cutting off such peripheral suction and instead cutting on said spinning suction, so that said fiber stream is supplied to said fiber-collecting surface and said thread end is returned to said fiber-collecting surface.

16. A method as in claim 14, wherein:

said preparing step includes:

establishing spinning suction in a housing which receives a spinning rotor of said spinning apparatus, feeding said thread end into said spinning apparatus, without touching said fiber-collecting surface, and subsequently cutting off said spinning suction and instead activating suction outside said fiber transport path on said periphery of a fiber transport roller arranged downstream from said opening means, so that, whenever said feed device is switched on again, said fiber stream is guided beyond said feed channel means mouth and is sucked off; and wherein said starting actual spinning step includes:

cutting off such peripheral suction and instead cutting on said spinning suction, so that said fiber stream is supplied to said fiber-collecting surface and said thread end is returned to said fiber-collecting surface.

17. A spinning apparatus for drawing off a thread end from a fiber-collecting surface with fibers continuously tied thereinto, comprising:

feed means for supplying a sliver;

opening means for receiving said sliver and opening same into separated fibers;

a fiber transport path along which flows said separated fibers, collectively defining a fiber stream;

a fiber-collecting surface for collecting said opened fibers thereon to be subsequently drawn off as thread, said surface being associated with open-end spinning means feed channel means for providing passage of opened fibers from said opening means to said fiber-collecting surface;

controllable suction source means for providing a suction force;

first suction line means, adapted for selectively providing suction to said fiber-collecting surface from said suction source means in the form of spinning suction which permits normal draw off of thread from said fiber-collecting surface;

second suction line means, adapted for selectively providing suction to the periphery of said opening means from said suction source means in the form of deflecting suction which deflects opened fibers from a mouth of said fiber channel means to thereby prevent their being supplied to said fiber-collecting surface; and suction control means, operatively associated with said suction source means and said first and second suction lines, for controllably varying the respective amounts of spinning and deflecting suction so that inconspicuous thread joins are produced by said spinning apparatus.

18. An apparatus as in claim 17, wherein to prepare for the start of spinning, said feed means is actuated to supply sliver to said opening means, and said suction control means controls said suction source means and second suction line means so as to provide a degree of deflecting suction sufficient to deflect at least a portion of said fiber stream away from said mouth of said feed channel means while a loose thread end is provided to said fiber-collecting surface, whereby opened fibers are gradually collected on said surface.

19. An apparatus as in claim 18, wherein to start actual spinning operation, said suction control means controls said suction source means and said second suction line means so as to terminate said deflecting suction while providing spinning suction, whereby a thread end is drawn off from said fiber-collecting surface with opened fibers supplied thereto being continuously tied in to said thread end so that a continuous thread is produced.

20. An apparatus as in claim 17, wherein, under the control of said suction control means, said suction source means is selectively operatively associated with one of said fiber-collecting surface, in the form of said spinning suction, and said opening means, in the form of said deflecting suction.

21. An apparatus as in claim 20, wherein said suction control means can establish a variable intermediate position which causes both said fiber-collecting surface and said opening means to be subjected to suction from said suction source means at the same time, and in controlled degrees.

22. An apparatus as in claim 17, wherein said suction control means has two control bores, of which one is adapted to be brought in operative association with said first suction line means associated with said fiber-collecting surface, and the other of which is adapted to be brought in operative association with said second suction line means associated with said opening means.

23. An apparatus as in claim 22, wherein stationary and movable edges of bores within said suction control means pairably define cutting devices which prevent the jamming of fibers therein.

24. An apparatus as in claim 17, further including a housing for receiving said opening means, said housing being closed against extraneous air inflows adjacent the region where said feed means supplies sliver thereto.

25. An apparatus as in claim 24, wherein said opening means housing has a controllable air-inflow orifice therein.

26. An apparatus as in claim 25, wherein said controllable air-inflow orifice is arranged in a peripheral wall of said opening means housing between the region where said feed means supplies sliver thereto and said mouth of said feed channel means.

27. An apparatus as in claim 26, wherein said controllable air-inflow orifice defines a dirt separation orifice adapted for the removal of dirt from said opening means housing.

28. An apparatus as in claim 25, wherein opening of said air-inflow orifice is adapted to be controlled from an automated servicing trolley movable among several spinning apparatuses.

29. An apparatus as in claim 25, wherein said air-inflow orifice includes a flap defining a closing member associated therewith.

30. An apparatus as in claim 25, wherein a closing member movable in a non-uniform way under control of said suction control means is operatively associated with said air-inflow orifice.

31. An apparatus as in claim 24, wherein a controllable diaphragm is provided in said opening means housing to cover said mouth of said feed channel means.

32. An apparatus as in claim 31, wherein said diaphragm comprises essentially an integral extension of said peripheral wall of said opening means housing.

33. A device as claimed in claim 32, wherein both sides of said diaphragm overlap said peripheral wall so that no projecting edges are present along a fiber transport direction, thereby preventing damage to fibers within said opening means housing.

34. An apparatus as in claim 31, wherein said opening means comprises a rotatable opening roller, and said diaphragm is movable parallel to an axis of rotation of said opening roller.

35. An apparatus as claimed in claim 31, wherein said diaphragm has a predetermined profile which mechanically controls the degree of opening thereof in response to actuation thereof.

36. An apparatus as in claim 35, wherein said profile is defined so as to move said diaphragm in a non-uniform way in response to actuation by said suction control means.

37. An apparatus as in claim 17, wherein said suction control means is adapted to be controlled from an automated servicing trolley movable among several spinning apparatuses.

38. An apparatus as in claim 37, wherein said suction control means includes a non-return valve adapted for response to physical actuation by said trolley so as to vary said spinning and deflecting suction.

39. An apparatus as in claim 38, including control drive means for actuating said suction control means in one direction of movement and a spring element for return actuation thereof.

40. An apparatus as in claim 37, wherein said second suction line means is adapted to be provided suction from a second suction source associated with said servicing trolley instead of from said controllable suction source means.

41. An apparatus as in claim 37, wherein said suction control means is adapted to be controlled by suction provided by the connection of a suction-air line extendable from said servicing trolley to said suction control means.

42. An apparatus as in claim 17, further comprising:

a fiber transport roller arranged downstream from said opening means relative the flow direction of said fiber stream; and wherein said second suction line means is adapted to selectively provide suction to the periphery of said fiber transport roller instead of to the periphery of said opening means.

43. An apparatus as in claim 42, wherein said fiber transport roller has a peripheral surface which is divided into three radial sectors comprising a collecting sector, a transfer sector and blanking sector for collecting fibers thereon, transferring fibers therefrom and preventing accumulation of fibers thereon, respectively.

44. A spinning apparatus as in claim 17, wherein:

said open-end spinning means includes a spinning rotor received in a housing; and said first suction line means is adapted for selectively providing suction to such rotor housing whereby same is in turn provided to said fiber-collecting surface.

45. A spinning apparatus as in claim 17, wherein said open-end spinning means includes friction rollers.

46. A spinning apparatus for drawing off a thread end from a fiber-collecting surface with fibers continuously tied thereinto, comprising:

feed means for supplying a sliver;

opening means for receiving said sliver and opening same into separated fibers;

a fiber transport path along which flows said separated fibers, collectively defining a fiber stream;

a fiber-collecting surface for collecting said opened fibers thereon to be subsequently drawn off as thread, said surface being associated with an open-end spinning means;

feed channel means for providing passage of opened fibers from said opening means to said fiber collecting surface;

first suction source means for providing a suction force in the form of spinning suction;

first suction line means, adapted for selectively providing said spinning suction to said open-end spinning means which permits normal draw-off of thread from said fiber-collecting surface;

first suction control means, operatively associated with said first suction source means and said first suction line means, for controllably varying the amount of said spinning suction;

second suction source means for providing a suction force in the form of a deflecting suction;

second suction line means, adapted for providing said deflecting suction to the periphery of said opening means which deflects opened fibers from a mouth of said feed channel means to thereby prevent their being supplied to said fiber-collecting surface;

second suction control means, operatively associated with said second suction source means and said second suction line means, for controllably varying the amount of said deflecting suction;

control device means for operating said first suction control means and said second suction control means in a coordinated manner to vary the respective amounts of spinning and deflecting suction so that inconspicuous thread joins are produced by said spinning apparatus.

47. An apparatus as in claim 46, wherein said first suction control means, said second suction control means, and said control device means for operating such first and second suction control means collectively function so that when spinning suction is provided at said first suction line means, no deflecting suction is provided at said second suction lines means, and that when no spinning suction is provided at said first suction line means, deflecting suction is provided at said second suction line means.

48. An apparatus as in claim 46, wherein said first and second suction source means collectively comprise a single combined suction source means which via operation of said first and second suction control means may selectively provide either said spinning suction in said first suction line means or said deflecting suction in said second suction line means.

49. An apparatus as in claim 47, wherein said first and second suction source means collectively comprise a single combined suction source means which via function of said control device means selectively provides spinning suction in said first suction line means or deflecting suction in said suction line means.

* * * * *